US006587023B2

(12) United States Patent
Miyazaki et al.

(10) Patent No.: US 6,587,023 B2
(45) Date of Patent: Jul. 1, 2003

(54) ELECTROMAGNETIC INDUCTION DEVICE

(75) Inventors: Sinobu Miyazaki, Osaka (JP); Fumiaki Yamagata, Sanda (JP); Hideaki Souma, Osaka (JP); Shinichi Masuda, Tondabayashi (JP); Yutaka Takashige, Kishiwada (JP); Seiji Kambara, Nishinomiya (JP)

(73) Assignees: Tabuchi Electric Co., Ltd., Osaka (JP); Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/814,936

(22) Filed: Mar. 23, 2001

(65) Prior Publication Data

US 2001/0024152 A1 Sep. 27, 2001

(30) Foreign Application Priority Data

Mar. 24, 2000 (JP) ..... 2000-083867
Mar. 29, 2000 (JP) ..... 2000-092275
Mar. 29, 2000 (JP) ..... 2000-092276

(51) Int. Cl.[7] ..... H01F 27/02

(52) U.S. Cl. ..... 336/83; 336/198; 336/200; 336/208; 336/212

(58) Field of Search ..... 336/198, 208, 336/178, 90, 96, 200, 223, 205–207, 83, 212–214

(56) References Cited

U.S. PATENT DOCUMENTS 3,676,814 A * 7/1972 Trunzo et al. ..... 336/205
4,857,878 A * 8/1989 Eng, Jr. et al. ..... 336/192
4,858,095 A * 8/1989 Narita et al. ..... 363/21
4,885,445 A * 12/1989 Taniguchi ..... 336/178
5,010,314 A * 4/1991 Estrov ..... 336/198
5,359,313 A * 10/1994 Watanabe et al. ..... 336/178
5,790,005 A * 8/1998 Santi et al. ..... 335/296
5,801,379 A * 9/1998 Kouznetsov ..... 250/286
6,201,463 B1 * 3/2001 Yamashita et al. ..... 336/198

FOREIGN PATENT DOCUMENTS

JP 62-213221 * 9/1987

* cited by examiner

*Primary Examiner*—Tuyen T. Nguyen
(74) *Attorney, Agent, or Firm*—Birch, Stewart, Kolasch & Birch, LLP

(57) ABSTRACT

An electromagnetic induction device having a flat configuration that requires a relatively small space for installation on a circuit substrate includes a flat bobbin (1T) having a length (D1) smaller than a radial size (D2) thereof has primary and secondary windings (11, 12) wound thereon. This bobbin (1T) has coaxially aligned throughholes (20, 22) defined therein into which core legs (24T and 24T) of generally T-shaped first and second core pieces (23T, 23T) are inserted from opposite directions, respectively. Respective core arms (25T, 25T) of the first and second core pieces (23T, 23T) extend parallel to each other.

12 Claims, 18 Drawing Sheets

ELECTROMAGNETIC INDUCTION DEVICE

RELATED APPLICATION

This application is related to co-pending U.S. application Ser. No. 09/586,565 filed Jun. 2, 2000.

BACKGROUND OF THE INVENTION

1. Field of the Invention

The present invention relates to an electromagnetic induction device such as, for example, a transformer utilizing an inverter and, more particularly, to the electromagnetic induction device of a type finding a principal application in, for example, driving a magnetron.

2. Description of the Prior Art

FIG. 27 illustrates an inverter-equipped high frequency heating apparatus such as, for example, an electronic oven, of a type disclosed in the Japanese Examined Patent Publication No. 7-40465. This known high frequency heating apparatus includes a rectifying circuit 62 for rectifying and smoothing an electric power from a commercial power source 61, an inverter 63 for converting the rectified and smoothed electric power into a high frequency alternating current of a frequency equal to or higher than 20 kHz, and a transformer 64 including a gapped core and having a primary winding 64*p* to which the high frequency alternating current is supplied from the inverter 63. The transformer 64 also has a secondary winding 64*s*, and a high frequency output voltage emerging from the secondary winding 64*s* of the transformer 64 is, after having been rectified and smoothed by a half-wave rectifying circuit 65, supplied as a direct current high voltage to a magnetron 66. The transformer 64 furthermore has a heater winding 64*h* for driving the magnetron 66 which, when receiving the direct current high voltage, generates microwaves.

The transformer 64 discussed above is shown in a sectional representation in FIG. 29. The known transformer 64 comprises a bobbin 70 on which the primary winding 64*p*, the secondary winding 64*s* and the heater winding 64*h* are wound therearound in an axially spaced relation to each other. This known transformer 64 also comprises generally U-shaped magnetic core pieces 71 and 72 each having a pair of legs and a bridge arm 71*a* or 71*b* connecting the legs together, and one of the legs of each magnetic core piece 71 and 72 is received within a cylindrical hollow 70*s* of the bobbin 70. The respective legs of the magnetic core pieces 71 and 72 received within the cylindrical hollow 70*s* are spaced from each other by a spacer 70*g* of a thickness G that is formed within the cylindrical hollow 70*s* to define a magnetic gap 73 between end faces of the pairs of the legs of the magnetic core pieces 71 and 72. In a condition so assembled, the magnetic core pieces 71 and 72 form a core assembly 75 of a generally rectangular shape having a generally rectangular center void, wherein a coupling coefficient between the primary and secondary windings 64*p* and 64*s* is within the range of 0.6 to 0.8 so that the secondary winding can have a leakage inductance. This structure of the known transformer makes no use of a high frequency choke coil on the side of the secondary winding that has hitherto been required in the inverter circuit for use with the magnetron.

It has, however, been found that the known transformer 64 discussed above has a problem. Specifically, since a magnetic circuit C is formed only on one side of the primary and secondary windings 64*p* and 64*s* (i.e., on a left side as viewed in FIG. 29) and since the respective bridge arms 71*a* and 71*b* of the core pieces 71 and 72 forming the magnetic circuit C extend parallel to each other while spaced a substantial distance from each other, a magnetic loss is significant and no strong magnetic flux can be obtained. For this reason, in order to secure a required output voltage, the number of turns of the primary and secondary windings 64*p* and 64*s* cannot be reduced. Accordingly, with the known transformer 64, if the width (as measured in a direction conforming to the longitudinal sense of the bobbin 70) of each of the primary and secondary windings 64*p* and 64*s* is reduced so that the resultant transformer can have a substantially flat configuration, the coil outer diameter (as measured in a direction perpendicular to the longitudinal sense of the bobbin 70) of each of the primary and secondary windings 64*p* and 64*s* tends to increase for the number of turns thereof necessitated to secure the required output voltage. The consequence is that the known transformer 64 is relatively bulky, having a relatively large transverse dimension as measured in a lateral direction conforming to the coil outer diameter. As such, the transformer 64 of the structure discussed above is incapable of being assembled compact and requires a relatively large space for mounting on a circuit substrate.

The above discussed transformer 64 has another problem. As discussed above, the transformer 64 has the spacer 70*g* for defining the gap 73, that is positioned at a location surrounded by the primary winding 64*p*, and also makes use of the generally U-shaped core pieces 71 and 72 wherein the legs of the core piece 71 have a different from that of the core piece 72 and wherein one of the legs of the core piece 71 and one of the legs of the core piece 72 are inserted into the cylindrical hollow 70*s* of the bobbin 70. Accordingly, the known transformer 64 requires two types of core pieces of different sizes and this leads to increase of the type of core pieces and, hence, that of the manufacturing cost. The high frequency heating apparatus constructed utilizing the transformer 64 of the structure shown in and described with particular reference to FIG. 29 is generally mounted on a circuit substrate of a relatively large size on which electric component parts connected to the transformer 64 such as a primary circuit including the rectifying circuit 62 and the inverter 63 and a secondary circuit including the half-wave rectifying circuit 65 as shown in FIG. 27 are formed. Considering that the transformer 64 has a relatively large transverse dimension as discussed hereinbefore, mounting of such transformer 64 requires a further increase of the size of the circuit substrate. Also, since the secondary circuit defines a high voltage generating circuit, the circuit substrate must have a correspondingly increased size so that the secondary circuit can be spaced a sufficient distance from the primary circuit and a ground to provide a sufficient electrical insulation therebetween. For these reasons, a circuit unit including the transformer 64 mounted on the circuit substrate requires a relatively large space for installation and, therefore, application thereof is limited, thereby constituting a cause of the high frequency heating apparatus incapable of being manufactured compact.

Accordingly, the present invention has been devised to substantially eliminate the above discussed problems and is intended to provide an electromagnetic induction device that can be assembled having a substantially flat configuration without incurring an increase of the transverse dimension.

SUMMARY OF THE INVENTION

In order to accomplish the foregoing object of the present invention, there is provided an electromagnetic induction device including a core assembly for defining a magnetic circuit and comprised of generally T-shaped or L-shaped first and second core pieces, a generally flat bobbin having an axial width and a radial size, the axial width being smaller than the radial size and also having a bore defined therein so as to extend in an axial direction of the bobbin, and a winding member mounted on the bobbin. The core legs of the first and second core pieces are inserted into the bore of the flat bobbin while the core arms of the first and second core pieces extend parallel to each other.

The term "T-shaped" referred to hereinbefore and hereinafter in connection with each of the core pieces is intended to mean the shape in a stereoscopic vision similar to the shape of a figure "T" and does not include the T-shape as viewed in a side representation of a disc having a leg secured at one end to a center of the disc so as to extend perpendicular to the disc. Similarly, the term "L-shaped" referred to hereinbefore and hereinafter in connection with each of the core pieces is intended to mean the shape in a stereoscopic vision similar to the shape of a figure "L" and does not include the L-shape as viewed in a side representation of a disc having a leg secured to an off-center peripheral portion of the disc so as to extend perpendicular to the disc.

According to the present invention, since no core piece is positioned laterally of the winding member and, therefore, the electromagnetic induction device can have a reduced lateral dimension as measured in a direction perpendicular to the axial direction of the winding member. Moreover, since the bobbin is of a flat configuration having a reduced axial width, the spacing between the core arms of the T-shaped core pieces can be reduced in size, making it possible to form a strong magnetic field whereby an excellent magnetic characteristic can be obtained. Also, since the core pieces have the same shape and size, the number of types of core pieces required to form the core assembly can advantageously be reduced, thereby reducing the manufacturing cost.

In a preferred embodiment of the present invention, the winding member may include primary and secondary windings mounted on the bobbin in axially spaced relation to each other and, at the same time, respective free ends of the core legs of the first and second core pieces may confront with each other to define a gap therebetween. According to this design, the presence of the gap is effective to provide the electromagnetic induction device having a characteristic in which a magnetic saturation takes place hardly.

In a preferred embodiment of the present invention, a coupling coefficient between the primary and secondary windings is set to a value within the range of 0.6 to 0.8. Selection of the coupling coefficient within the particular range is effective to eliminate the need to use a high frequency choke in a secondary circuit where the electromagnetic induction device of the present invention is utilized in a high frequency heating apparatus of an inverter type.

Also, in one preferred embodiment of the present invention, the winding member includes primary and secondary windings mounted on the bobbin in axially spaced relation to each other. The primary winding may have lead lines extending from respective opposite ends thereof and fitted with a terminal member adapted to be connected with a terminal piece, mounted on a circuit substrate, by screwing or insertion, whereas the secondary winding may have opposite ends fitted with respective pin terminals fixedly secured to the bobbin and adapted to be inserted into the circuit substrate. This design is effective to allow the primary winding, generally prepared from a thick electric wire, to be easily connected to the circuit substrate. Also, since the opposite ends of the secondary winding prepared generally from a thin electric wire are connected with the pin terminals fixedly mounted on the bobbin, there is no possibility that one or both of the opposite ends of the secondary winding from which a high voltage is generated may accidentally fly during connection of the electromagnetic induction device with the circuit substrate to eventually result in contact with adjacent conductors.

Again in one preferred embodiment of the present invention, at least a portion of the winding member is an electric wire coated with a thermally fusible material, that is wound into a uniformly layered coil block, and is subsequently caked into a layered coil block by heating to fuse the thermally fusible material, said caked coil block being mounted on the bobbin. According to this embodiment, since the winding members prewound into the uniformly layered coil block is mounted on the bobbin, the winding member can readily and easily be mounted on the bobbin having a relatively small winding width as measured in a direction axially of the bobbin.

In an alternative embodiment of the present invention, the winding member includes primary and secondary windings and the primary winding has opposite lead lines that are connected with a primary circuit substrate included in the high frequency heating apparatus. The electromagnetic induction device may further include a secondary circuit substrate. The secondary winding is connected with the secondary circuit substrate. In this case, the bobbin is preferably formed integrally with a substrate mount for supporting the secondary circuit substrate.

According to this alternative embodiment, since the electromagnetic induction device has a flat configuration having a relatively small radial size, the integral provision of the secondary circuit substrate does not result in increase of the overall size thereof and does also allow the electromagnetic induction device in the form as separated from the primary circuit substrate to be installed at a relatively small space that may be chosen as desired from a vacant space available within the high frequency heating apparatus. Accordingly, if the electromagnetic induction device which would occupy a relatively large space on the circuit substrate is positioned at a suitable location separated from the circuit substrate, an apparatus equipped with such electromagnetic induction device, for example, the high frequency heating apparatus can advantageously be assembled compact in size. Moreover, since the primary circuit substrate electrically connected with the primary winding and the secondary circuit substrate connected with the secondary winding for generating a high voltage are separated from each other, a sufficient distance of insulation can be secured without incurring an increase in size of the space for installation.

Again in a further alternative embodiment of the present invention, the substrate mount is positioned laterally of the bobbin and radially outwardly of at least one of the primary and secondary windings. This design is particularly advantageous in that since the electromagnetic induction device according to the present invention has a relatively small radial size because of the absence of any core piece at a location radially outwardly of the bobbin, integration of the secondary circuit substrate with a lateral portion of the bobbin does not result in increase in size.

Also, the substrate mount may alternatively be formed in a collar that defines one axial end of the bobbin, and is positioned axially outwardly of the primary and secondary windings. This design allows the electromagnetic induction device to have a flat configuration and, therefore, even though the secondary circuit substrate is formed integrally with the color eventually forming one axial end of the bobbin, the electromagnetic induction device will not increase in size.

In a further preferred embodiment of the present invention, the bobbin may include a plurality of bobbin pieces defined by dividing the bobbin in a direction axially thereof and wherein each of the core pieces is embedded in the corresponding bobbin piece preferably by an insert-molding technique. Since in the electromagnetic induction device embodying the present invention, the core pieces are mounted on and integrated together with the respective bobbin pieces by the use of the insert-molding technique, this design is effective to eliminate the need to employ a manufacturing step of fixing the core pieces by a fixture such as a core clip after the latter have been assembled into the bobbin and, therefore, the number of the manufacturing steps can correspondingly be reduced along with reduction in number of component parts, resulting in reduction in manufacturing cost.

Preferably, at least a portion of outer surface of the core arm of each of the first and second core pieces on which outer surface no corresponding core leg is formed is exposed to an outside, so that heat evolved in the respective core piece embedded in the associated bobbin piece by the insert-molding technique can advantageously dissipated.

In a yet further preferred embodiment of the present invention, the bobbin may have at least one winding groove defined therein for receiving the winding member provided therein and may be made up of a plurality of bobbin pieces defined by dividing the bobbin in a direction axially thereof In such case, the plural bobbin pieces are to be connected together such that a groove width of the winding groove straddling the neighboring bobbin pieces is variable. According to this design, change of the groove width of the winding groove can effectively result in change in winding width of the winding member.

According to a still further preferred embodiment of the present invention, the bobbin may include at least first and second bobbin pieces each including a hollow cylindrical body having a throughhole defined therein. The bore is defined by the respective throughholes in the bobbin pieces when the respective hollow cylindrical bodies of the first and second bobbin pieces are coaxially aligned with each other. The bobbin pieces are assembled together to complete the bobbin with the hollow cylindrical body in the first bobbin piece inserted into the hollow cylindrical body in the second bobbin piece.

In this embodiment, one of an inner peripheral surface of the hollow cylindrical body in the first bobbin piece and an outer peripheral surface of the hollow cylindrical body in the second bobbin piece is formed with an engagement projection, and the other of the inner and outer peripheral surfaces of the hollow cylindrical bodies in the respective bobbin pieces is formed with an axially extending guide groove and a plurality of circumferentially extending engagement grooves communicated with the guide groove and spaced a distance from each other in a direction axially of the bobbin. Also, when the hollow cylindrical bodies of the first and second bobbin pieces are connected together one inserted into the other, the engagement projection is guided along the guide groove in the axial direction and is subsequently engaged in one of the engagement grooves upon relative displacement of the hollow cylindrical bodies in the circumferential direction. According to this structure, merely by selecting one of the engagement grooves to be engaged with the engagement projections, the width of the winding groove can be changed simply.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DETAILED DESCRIPTION OF THE EMBODIMENTS (First Preferred Embodiment)

Figure 1:
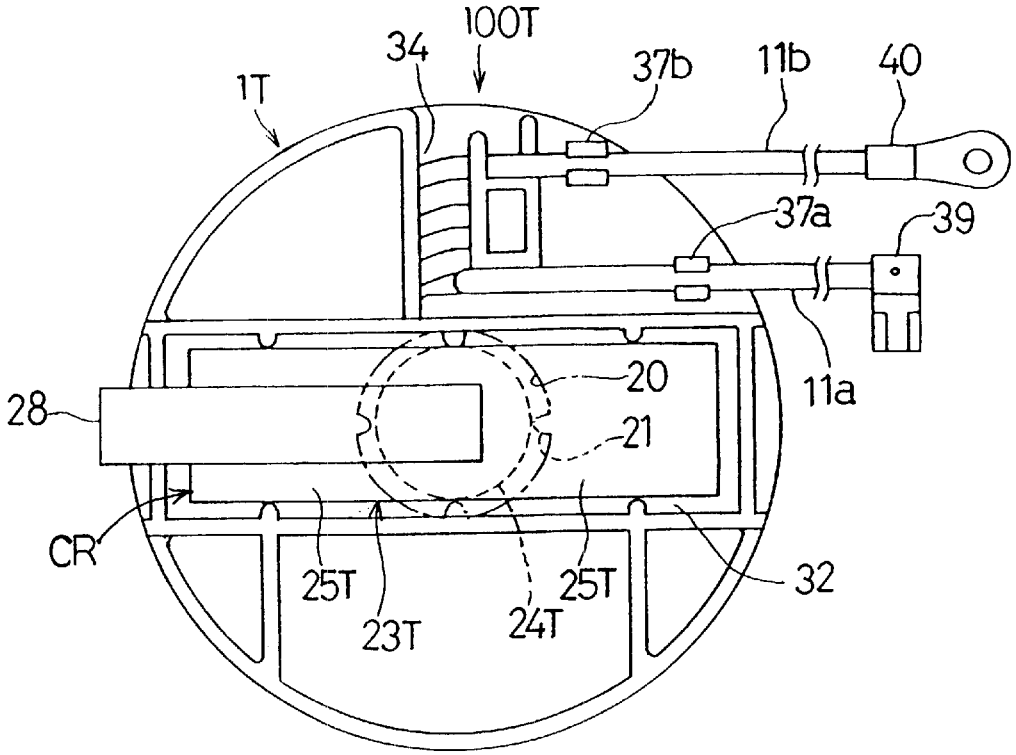
FIG. 1 is a top plan view of an electromagnetic induction device according to a first preferred embodiment of the present invention.
Figure 2:
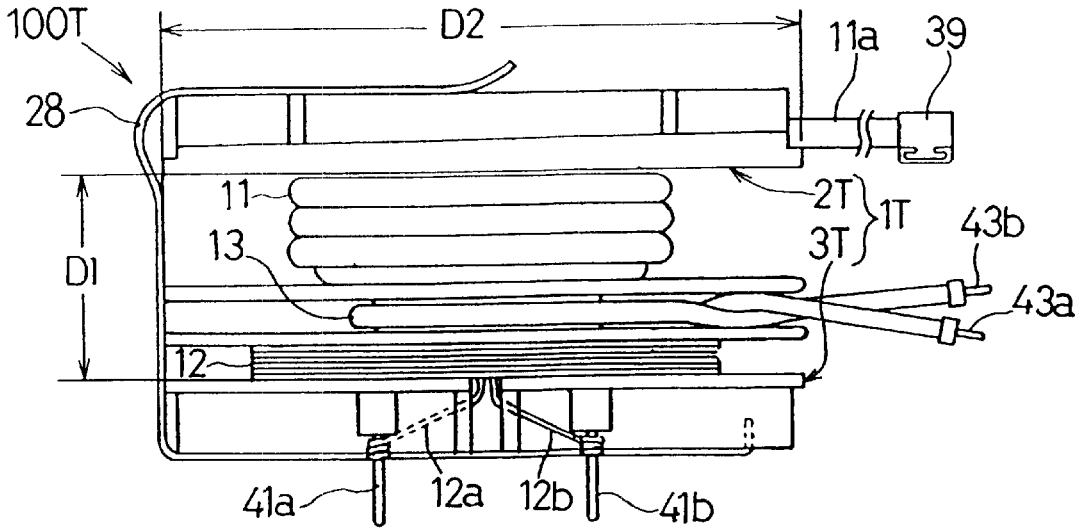
FIG. 2 is a front elevational view of the electromagnetic induction device shown in FIG. 1.

Referring first to FIGS. 1 to 3, there is shown a transformer 100T according to a first embodiment of the present invention. The transformer 100T is a sort of electromagnetic induction devices for driving a magnetron employed in a high frequency heating apparatus generally such as, for example, an electronic oven. The transformer 100T includes a bobbin 1T made of a synthetic resin having an electric insulating property and is, as shown in FIG. 4, made up of axially separated first and second bobbin pieces 2T and 3T. The first bobbin piece 2T includes a hollow cylindrical body 14 having its outer peripheral surface formed integrally with first, second and third annular collars 4, 7 and 8 that lie parallel to each other. This first bobbin piece 2T has a primary winding frame 9 in the form of a primary winding groove bound by a portion of the hollow cylindrical body 14 and the first and second annular collars 4 and 7, and a heater winding frame 10 in the form of a heater winding groove bound by another portion of the hollow cylindrical body 14 and the second and third annular collars 7 and 8. A primary winding 11 of the transformer 100T is coiled around and within the primary winding frame 9 whereas a heater winding 13 is wound in a single turn around and within the heater winding frame 10.

The second bobbin piece 3T includes a hollow cylindrical body 17 having an axial width smaller than that of the hollow cylindrical body 14 of the first bobbin piece 2T and also having its outer peripheral surface formed integrally with an fourth annular collar 18. The first and second bobbin pieces 2T and 3T are coupled together with the hollow cylindrical body 17 capped onto one of opposite ends of the hollow cylindrical body 14 remote from the first annular collar 4 to thereby complete the bobbin 1T with a secondary winding frame 19 in the form of a secondary winding groove consequently delimited between the third annular collar 8 and the fourth annular collar 18 for accommodating a secondary winding 12. The secondary winding 12 is in the form of a uniformly layered annular coil block having a plurality of layers of a multiplicity of turns of an electric wire caked together. This secondary winding 12 can be formed by coiling an electric wire, coated externally with a thermally fusible material, in a cylindrical form and then heating the coiled electric wire to fuse the thermally fusible material to allow turns of the wire coil to be eventually bonded together, thereby completing the uniformly layered annular coil block. The primary winding 11, the secondary winding 12 and the heater winding 13 are mounted on the bobbin 1T in an axially spaced relation to each other and, accordingly, when the bobbin 1T is to be assembled, the secondary winding 12 is first mounted externally on the hollow cylindrical body 17 of the second bobbin piece 3T and the second bobbin piece 3T with the secondary winding 12 is subsequently coupled with the first bobbin piece 2T with the hollow cylindrical body 17 capped onto that end of the hollow cylindrical body 14 of the first bobbin piece 2T.

The transformer 100T also includes a core assembly CR made of a magnetic material effective to form a magnetic circuit therein. The core assembly CR is made up of generally T-shaped first and second core pieces 23T and 23T of an identical shape and size, each including, as best shown in FIG. 3B, a cylindrical core leg 24T and a substantially rectangular core arm 25T having a width equal to or substantially equal to the diameter of the core leg 24T. Each core leg 24T lies perpendicular to the core arm 25T. The core assembly CR and the bobbin 1T are assembled together with the cylindrical legs 24T snugly received within the hollow cylindrical bodies 14 and 17 inwardly from opposite directions while the respective core arms 25T and 25T of the first and second core pieces 23T and 23T are, as shown in FIG. 4, accommodated within core chambers 32 and 33, formed respectively in the first and second bobbin pieces 2T and 3T, so as to extend parallel to each other in a direction radially of any one of the windings 11 to 13. It is to be noted that the core arm 25T of each core piece 23T has a length greater than the outer diameter of any one of the windings 11 to 13 so that opposite ends of the respective core arm 25T can protrude radially outwardly of any one of the windings 11 to 13.

As shown in FIG. 2, the bobbin 1T of the transformer 100T is of a flat configuration, having an axial width D1 thereof smaller than a radial size D2 as measured in a direction perpendicular to the axial width D1. The axial width D1 referred to above may be represented by the length of a cylindrical portion of the bobbin 1T around which the windings 11 to 13 are formed and may represent a distance between mutually confronting inner surfaces of the first and fourth annular collars 4 and 18 as measured in a direction parallel to the longitudinal axis of the bobbin 100T. The radial size D2 referred to above may be represented by one of the outer diameters of the first to fourth annular collars 4, 7, 8 and 18 which is the greatest of all if the first to fourth annular collars have varying outer diameters.

Figure 3A:
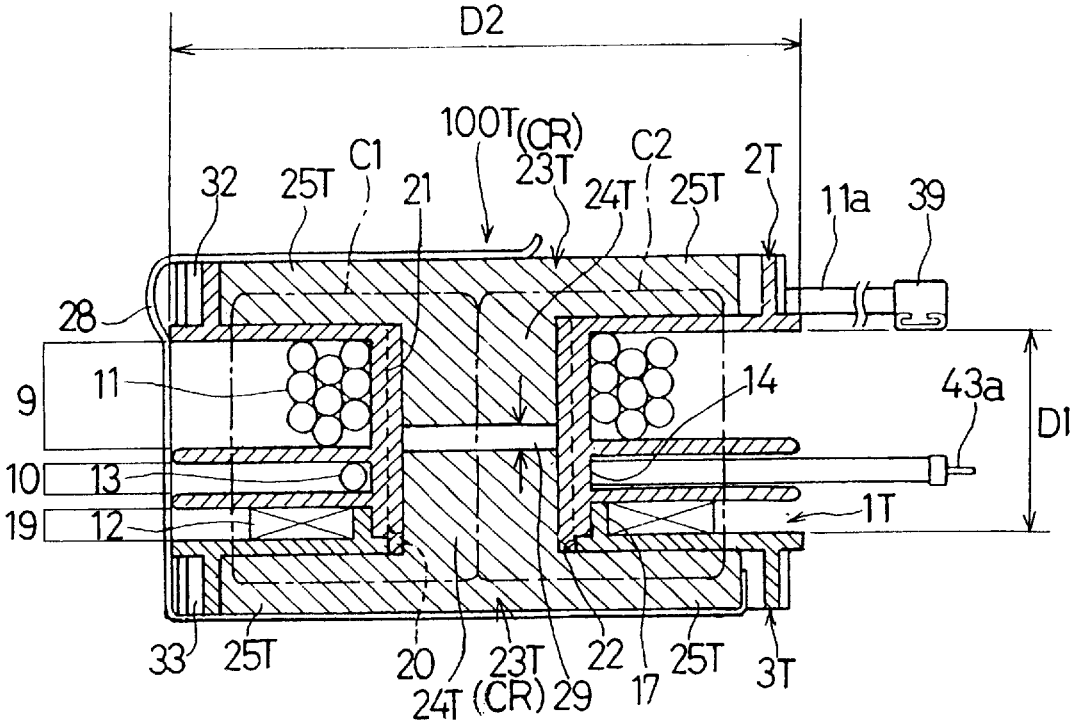
FIG. 3A is a longitudinal sectional view of the electromagnetic induction device shown in FIG. 1.
Figure 3B:
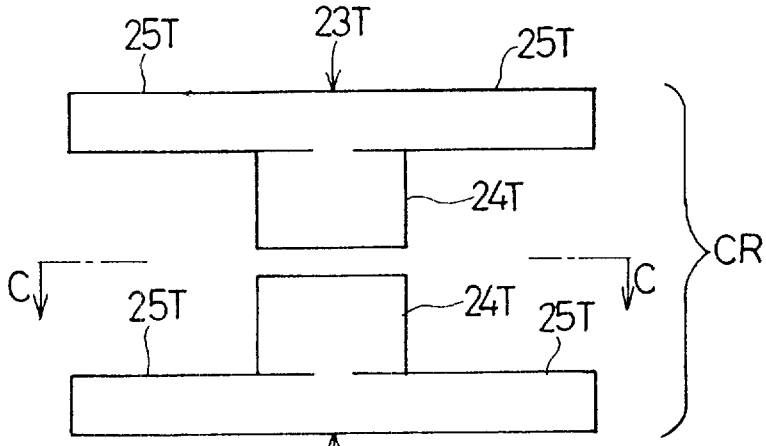
FIG. 3B is a side view of a core assembly made up of generally T-shaped core pieces employed in the electromagnetic induction device shown in FIG. 1.
Figure 4:
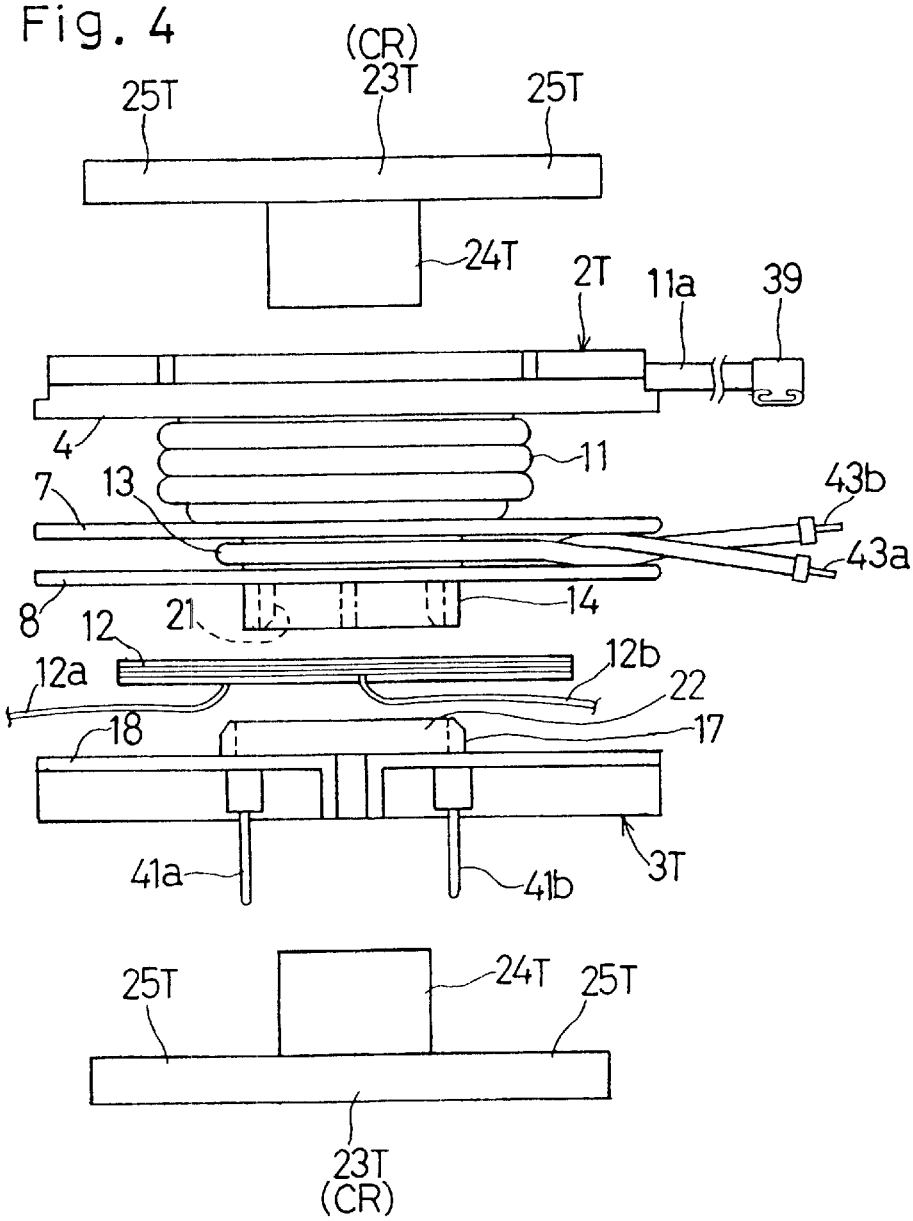
FIG. 4 is an exploded view of the electromagnetic induction device shown in FIG. 1.

Referring particularly to FIG. 3A, the bobbin 1T of the structure assembled in the manner described above has a bobbin hollow defined in part by a throughhole 20 in the hollow cylindrical body 14 of the first bobbin piece 2T and in part by a throughhole 22 in the hollow cylindrical body 17 in the second bobbin piece 3T that has a diameter greater than that of the throughhole 20 by a quantity equal to double the wall thickness of the hollow cylindrical body 14. The throughhole 20 of the first bobbin piece 2T has, as shown in FIG. 1, its inner surface formed with a plurality of, for example, four guide ribs 21 so as to protrude radially inwardly therefrom and spaced an equal distance, i.e., 90° from each other in a circumferential direction of the hollow cylindrical body 14.

Figure 3C:
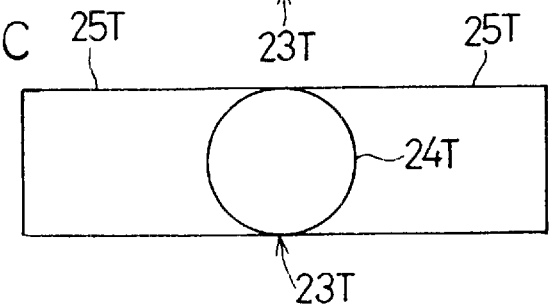
FIG. 3C is a cross-sectional view taken along the line C—C in FIG. 3B.

As shown in FIGS. 3B and 3C, the cylindrical core leg 24T of each core piece 23T is formed integrally with a portion of the corresponding core arm 25T so as to extend at right angles thereto to thereby render the respective core piece 23T to represent a generally T-shaped configuration. The T-shaped core pieces 23T and 23T forming the core assembly CR are identical in size and shape and are mounted on the bobbin 1T with the respective core legs 24T and 24T inserted into the associated throughholes 20 and 22 internally from opposite directions while having been guided along the guide ribs 21. In an assembled condition with the core pieces 23T and 23T mounted on the bobbin 1T, the first and second core pieces 23T and 23T are retained firmly in position with the respective core legs 24T and 24T received within the bobbin hollow by means of a generally U-shaped spring clip 28 that applies axially urging forces externally to the core arms 25T and 25T from opposite directions.

When the T-shaped first and second core pieces 23T and 23T are mounted on the bobbin 1T in the manner described above, respective free end faces of the core legs 24T and 24T of the first and second core pieces 23T and 23T confront with each other with a gap 29 defined therebetween. This gap 29 is so sized that the magnetic coupling coefficient between the primary and secondary windings 11 and 12 can attains a value within the range of 0.6 to 0.8. Thus, secondary a circuit coupled with the secondary winding can have a leakage inductance and, therefore, the use of a high frequency choke coil hitherto required in the prior art inverter for the magnetron is eliminated. It is to be noted that the gap 29 referred to above is positioned inwardly of the hollow cylindrical body 14 of the first and second bobbin pieces 2T and 3T where the primary and secondary windings 11 and 14 are formed. It is also to be noted that although in the illustrated embodiments the gap 29 has been described and shown as formed between the respective end faces of the core legs 24T and 24T of the first and second core pieces 23T and 23T, the gap may be zero in size, that is, the respective end faces of the core legs 24T and 24T of the first and second core pieces 23T and 23T may be held in contact with each other.

The primary winding 11 has a starting lead line 11*a* and a terminating lead line 11*b* opposite to the starting lead line 11*a*. The starting lead line 11*a* corresponds to one of opposite ends of the electric wire that was laid on the bobbin 1T at the time the electric wire was initially wound to form the primary winding 11 whereas the terminating lead line 11*b* corresponds to the other of the opposite ends of the electric wire that led out of the bobbin 1T after the electric wire had been completely wound to form the primary winding 11. The starting lead line 11*a* is drawn outwardly through a line pullout 34 in the form of a radially extending cutout groove defined in the first bobbin piece 2T and is trapped in position by a catch 37*a*. On the other hand, the terminating lead line 11*b* is drawn outwardly through the line pullout 34 and is trapped in position by a catch 37*b*.

An extremity of the starting lead line 11*a* is firmly connected with a flag-shaped terminal member 39 whereas an extremity of the terminating lead line 11*b* is firmly connected with an eyeleted terminal member 40. It is, however, to be noted that the eyeleted terminal member and the flag-shaped terminal member may be connected respectively with the extremity of the starting lead line 11*a* and that of the terminating lead line 11*b*. It is also to be noted that without using any terminal members, respective free ends of the starting and terminating lead lines 11*a* and 11*b* may be soldered directly to associated conductors on the circuit substrate on which the transformer 100T is mounted.

The heater winding frame 10 defined in the first bobbin piece 2T has the heater winding 13 wound therearound in a small number of turns. Opposite lead ends of this heater winding 13 are fitted with pin-type terminal members 43*a* and 43*b*.

Figure 27:
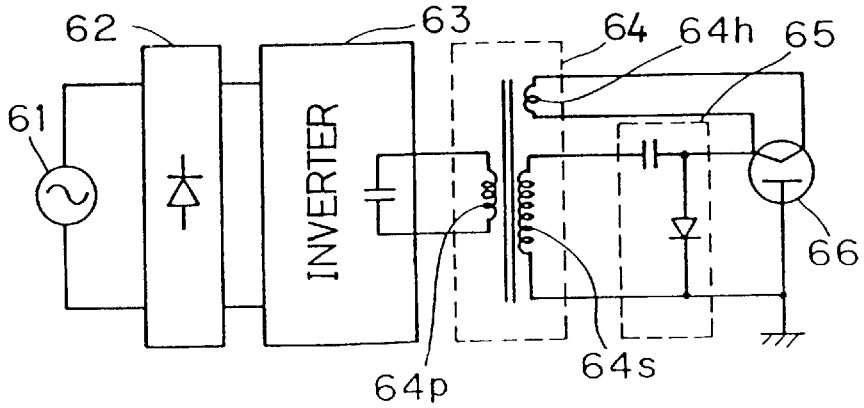
FIG. 27 is a circuit diagram showing an electric circuit of the high frequency heating apparatus with which the electromagnetic induction device of the present invention can be utilized.
Figure 28:
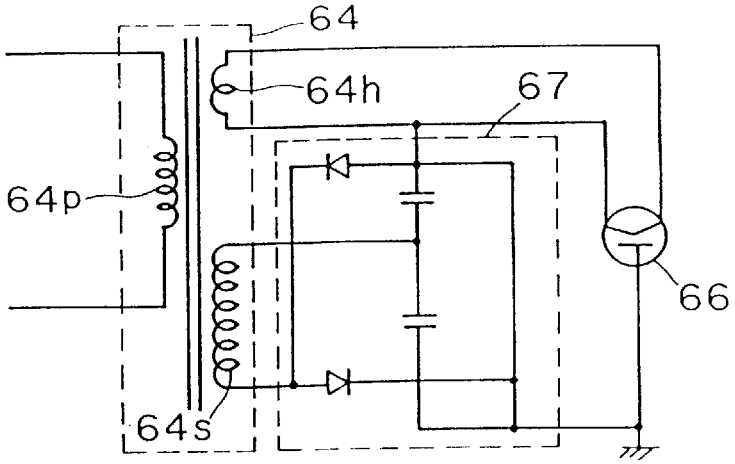
FIG. 28 is a circuit diagram showing a portion of the electric circuit employed in another high frequency heating apparatus.

The transformer 100T so constructed as hereinabove described is used for, example, driving a magnetron 66 of the high frequency heating apparatus shown in FIG. 27. In such application, the transformer 100T is incorporated in the high frequency heating apparatus in a manner which will now be described. Specifically, the transformer 100T is mounted on the circuit substrate for an inverter circuit in electrically connected relationship by first inserting and then soldering pin-type terminal members 41*a* and 41*b* shown in FIG. 2 into respective junction holes formed in the circuit substrate formed with such a circuit pattern as shown in FIG. 27; connecting the flag-shaped and eyelet terminal members 39 and 40 with respective junction tables provided on the circuit substrate by insertion and screw-fastening, respectively; and finally inserting the pin-type terminal members 43*a* and 43*b* into respective connecting terminals provided on the circuit substrate. It is to be noted that even though the circuit substrate is provided with a full-wave rectifying circuit 67 shown in FIG. 28 in place of the half-wave rectifying circuit 65, the transformer 100T can be mounted on the circuit substrate in the same manner as described above.

Figure 29:
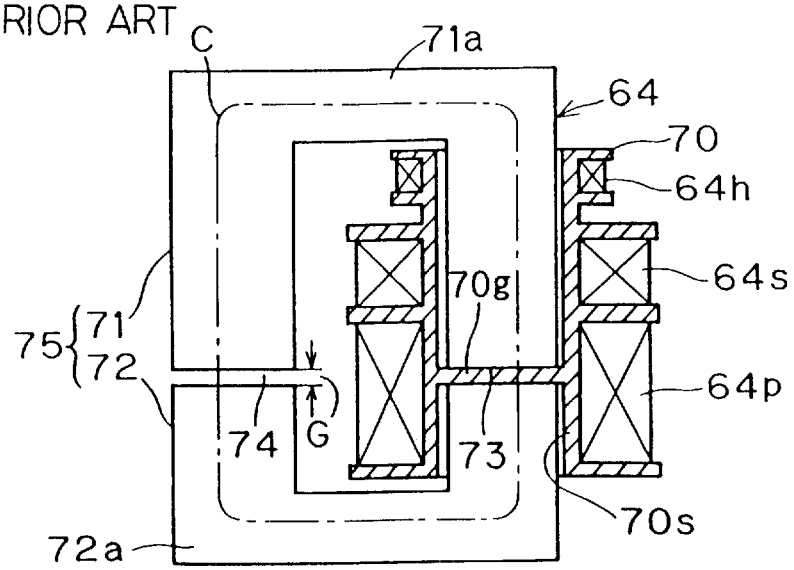
Fig. 29 PRIOR ART
FIG. 29 is a schematic longitudinal sectional view of the prior art electromagnetic induction device.

In the structure described above, since as clearly shown in FIG. 3, no core element exist at any location laterally of the windings 11 to 13, the transverse dimension of the transformer 100T as measured in a direction radially of the bobbin 1T can advantageously be reduced correspondingly. Moreover, since the bobbin 1T is of a flat configuration having a minimized axial width and having the first and second windings 11 and 12 of a minimized coil outer diameter, the spacing between the respective core arms 25T and 25T of the T-shaped first and second core pieces 23T and 23T can advantageously be reduced. Also, two magnetic circuits C1 and C2 extending through the respective core legs 24T and 24T and the respective core arms 25T and 25T of the first and second core pieces 23T and 23T can be formed. For this reason, as compared with the prior art transformer 64 in which the use of the U-shaped core pieces 71 and 72 has resulted in formation of only one magnetic circuit C as shown in FIG. 29, the transformer 100T of the present invention has such an advantage that the magnetic loss can be reduced and the magnetic flux passing through the core legs 24T and 24T, that is, the magnetic flux crossing the primary and secondary windings 11 and 12 can be intensified. In addition, since the bobbin 1T is flat in that the axial width D1 is smaller than the radial size D2 and, therefore, the spacing between the respective core arms 25T and 25T of the T-shaped first and second core pieces 23T and 23T is reduced, the transformer 100T has an additional advantage in that the magnetic fluxes of the magnetic circuits C1 and C2 can further be intensified.

Since the transformer 100T is effective to secure an excellent magnetic characteristic, even though it is assembled in a flat configuration with the axial width of each of the primary and secondary windings 11 and 12 reduced, it is possible to reduce the number of turns of each of the primary and secondary windings 11 and 12 that is required to secure a desired voltage and, correspondingly, the transverse dimension of the transformer 100T as measured in a direction radially of the bobbin 1T can be reduced, thereby rendering the transformer 100T to be compact. Accordingly, any possible increase of the space for installation of the transformer 100T on the circuit substrate can advantageously be suppressed. Also, since the T-shaped first and second core pieces 23T and 23T are of the same shape and dimensions, the both can be manufactured by the use of a common mold assembly, resulting in reduction in manufacturing cost. It is, however, to be noted that in the practice of the present invention, the first and second core pieces 23T and 23T may have different shapes and/or dimensions. In particular, the use of the core legs 24T and 24T of different lengths would result in adjustment of the position of the gap 29 and/or the coupling coefficient.

Also, since the opposite ends of the secondary winding 12 formed generally by the use of a thin electric wire are connected with the associated pin terminal members 41*a* and 41*b*, there is no possibility that the opposite ends of the secondary winding 12 from which a high voltage is generated may accidentally "fly" during connection of the transformer 100T with the circuit substrate and may therefore be brought into contact with the adjacent conductor or conductors.

The reason for formation of the secondary winding 12 in the form of the uniformly layered annular coil block with a plurality of layers of a multiplicity of turns of the electric wire caked together will now be described. The bobbin 1T made up of the first and second bobbin pieces 2T and 3T is made of a synthetic resin as hereinbefore described. Since the transformer 100T according to the illustrated embodiment of the present invention has a flat configuration and, for a given number of coil turns of each of the primary and secondary windings, the coil outer diameter of any one of the primary and secondary windings 11 and 12 tends to be greater than that where the transformer has a substantial thickness in contrast to the flat configuration, the first to fourth annular collars 4, 7, 8 and 18 of the bobbin 1T have a reduced thickness and, also, extend an increased distance radially outwardly from the cylindrical body portion of the bobbin 1T.

Because of those features, the first to fourth annular collars 4, 7, 8 and 18 are prone to warp in a direction axially of the bobbin 1T under the influence of strains induced as it is molded, or of an axially acting pressing force exerted by the corresponding windings 11 and 12 as the latter are turned around the cylindrical body portion of the bobbin 1T. In the case of the secondary winding frame 19 having a relatively small winding width as measured between the third and fourth annular collars 8 and 18 in a direction axially of the bobbin 1T, the occurrence of a warp in the third and fourth annular collars 8 and 18 as shown by the phantom lines in FIG. 5 may result in the winding width W that varies in a direction radially outwardly of the bobbin 1T. Considering that the axial width of the secondary winding 12 is generally restricted by the winding width W, a difficulty will be often encountered in winding of the thin electric wire within the secondary winding frame 19 to form the secondary winding 12 that represents the uniformly layered annular coil block. Failure to form the uniformly layered annular coil block results in lowering of the inter-layer insulating characteristic of the secondary winding 12.

Figure 5:
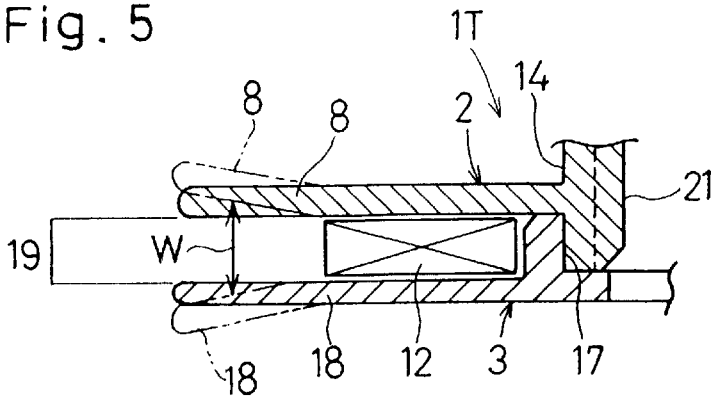
FIG. 5 is a fragmentary sectional view, on an enlarged scale, of a portion of the electromagnetic induction device, showing a winding mounted on a bobbin.

However, according to the present invention, since the secondary winding 12 is formed to represent the uniformly layered annular coil block prior to the mounting on the bobbin 1T as hereinbefore described, the secondary winding 12 can be mounted onto the secondary winding frame 19 satisfactorily even in the presence of the warp occurring in one or both of the third and fourth annular collars 8 and 18 as shown by the phantom line in FIG. 5, resulting in increase of the inter-layer insulating characteristic. It is, however, to be noted that where a margin is available in the coil length within the secondary winding frame 19, an electric wire having no thermally fusible material coated thereon may be wound directly within the secondary winding frame 19 to thereby form the secondary winding 12.

(Second Preferred Embodiment)

Figure 6A:
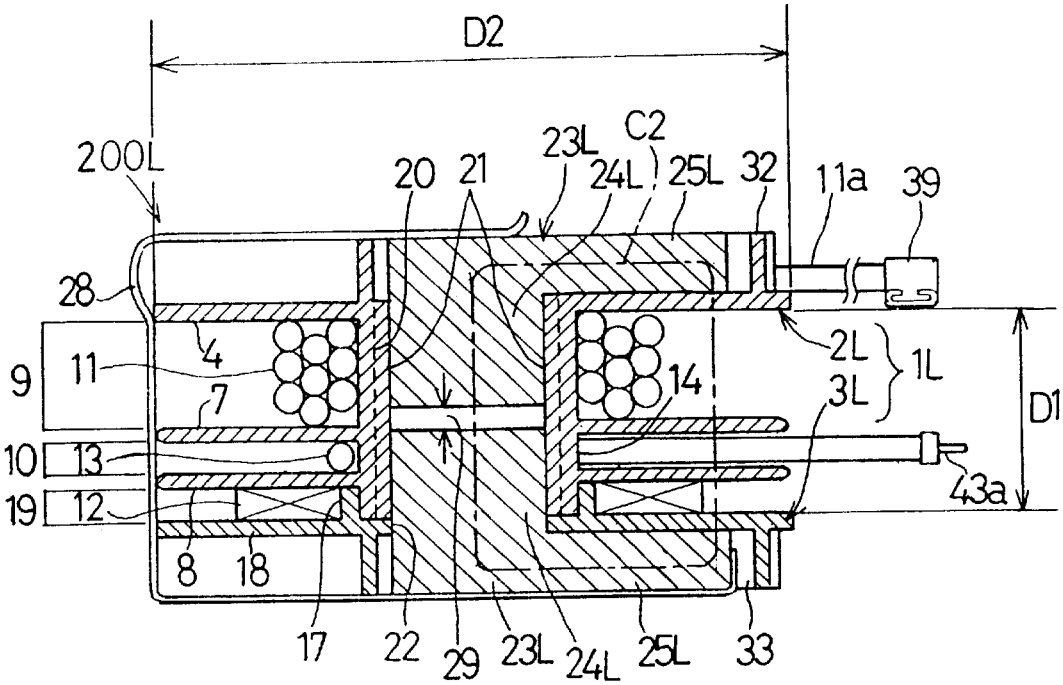
FIG. 6A is a longitudinal sectional view of the electromagnetic induction device according to a second preferred embodiment of the present invention.
Figure 6B:
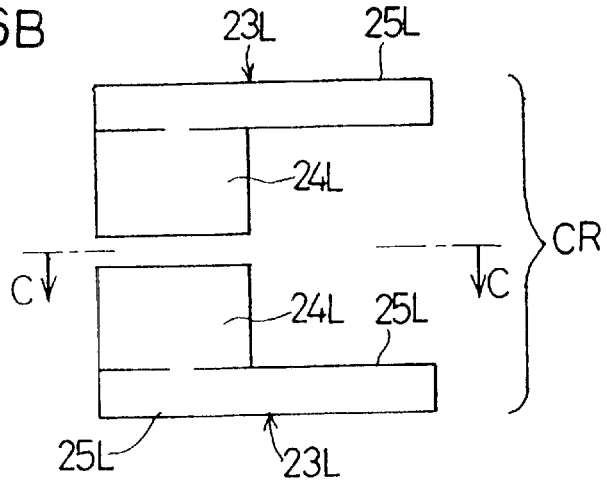
FIG. 6B is a schematic side view of the core assembly made up of generally L-shaped core pieces employed in the electromagnetic induction device shown in FIG. 6A.
Figure 6C:
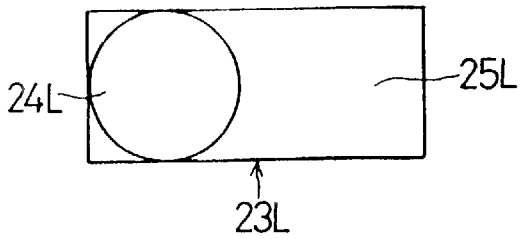
FIG. 6C is a top plan view of one of the L-shaped core pieces as viewed in a direction shown by the line C—C in FIG. 6B.

The transformer 200L according to a second preferred embodiment of the present invention is shown in FIGS. 6A to 6C. The core assembly CR employed in this transformer 200L is made up of generally L-shaped first and second core pieces 23L and 23L of an identical shape and size. The use of the L-shaped first and second core pieces 23L and 23L necessitates the use of the core chambers 32 and 33 of a shape different from those employed in the previously described embodiment for accommodating the first and second bobbin pieces 2L and 3L forming the bobbin 1L. Other structural features than those mentioned above are substantially similar to those in the transformer 100T according to the previously described embodiment.

As best shown in FIGS. 6B and 6C, each of the L-shaped core pieces 23L and 23L includes a cylindrical core leg 24L and a substantially rectangular core arm 25L having a width equal to or substantially equal to the diameter of the core leg 24L and formed integrally with one of opposite ends of the corresponding core arm 25L. The L-shaped first and second core pieces 23L and 23L are mounted on the bobbin 1L with the respective core legs 24L and 24L inserted into the associated throughholes 20 and 22 from opposite ends of the bobbin 1L while being guided along the guide ribs 21 and are retained in position in the bobbin 1L by the U-shaped spring clip 28 that applies axially urging forces externally to the core arms 25L and 25L from opposite directions.

When the L-shaped first and second core pieces 23L and 23L are mounted on the bobbin 1T in the manner described above, the respective free end faces of the core legs 24L and 24L of the first and second core pieces 23L and 23L confront with each other with a gap 29 defined therebetween. The coupling coefficient between the primary and secondary windings 11 and 12 is thus set to a value within the range of 0.6 to 0.8 and, therefore, the secondary circuit coupled with the secondary winding 12 can have a leakage inductance wherefore the use of a high frequency choke coil hitherto required in the prior art inverter for the magnetron is eliminated. It is to be noted that the gap 29 referred to above is positioned inwardly of the hollow cylindrical body 14 of the first and second bobbin pieces 2L and 3L where the primary and secondary windings 11 and 12 are formed. It is also to be noted that although in the illustrated embodiments the gap 29 has been described and shown as formed between the respective end faces of the core legs 24L and 24L of the first and second core pieces 23L and 23L, the gap may be zero in size, that is, the respective end faces of the core legs 24L and 24L of the first and second core pieces 23L and 23L may be held in contact with each other.

As such, even in the transformer 200L utilizing the L-shaped first and second core pieces 23L and 23L to form the core assembly CR, a relatively strong magnetic field can be developed in the magnetic circuit C2 passing through the core legs 24L and 24L and the core arms 25L and 25L of the first and second core pieces 23L and 23L, thereby bringing about effects similar to those afforded by the previously described transformer 100T.

(Third Preferred Embodiment)

Figure 7:
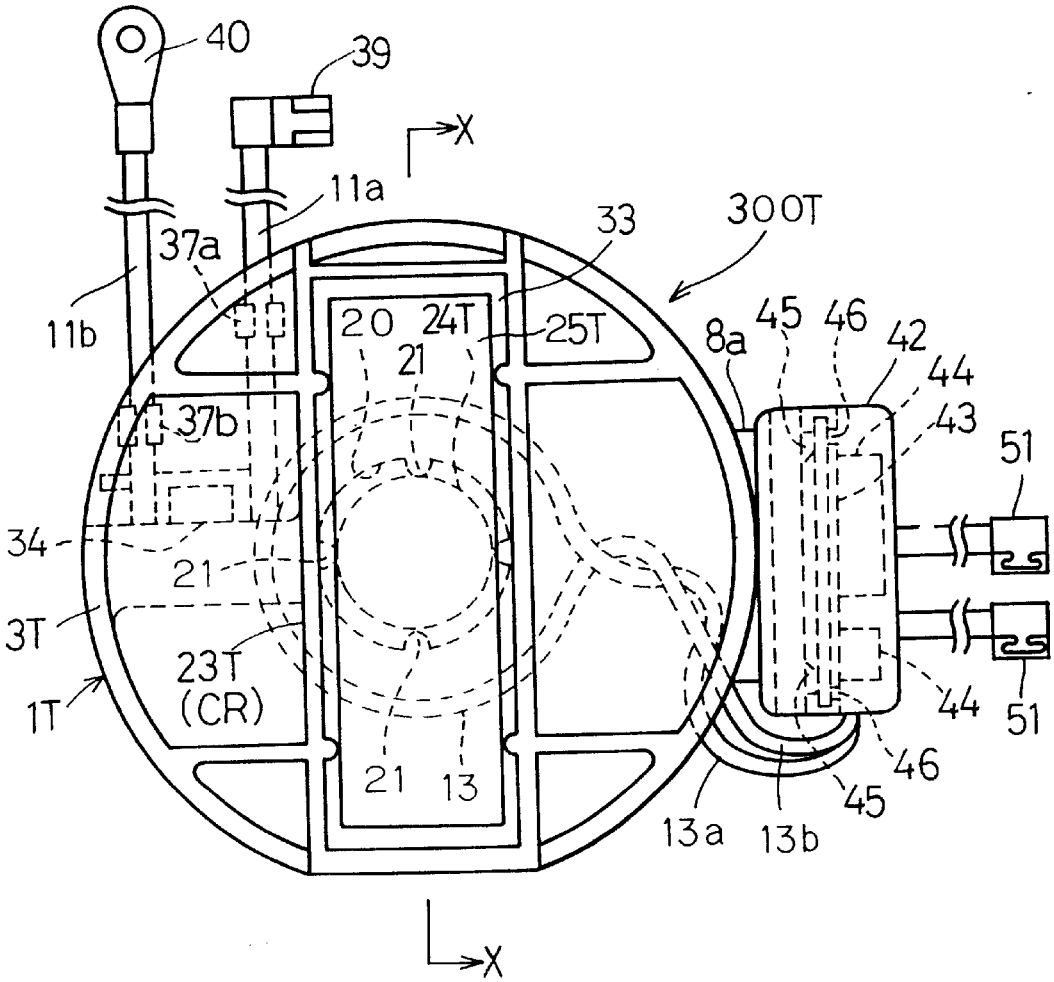
FIG. 7 is a top plan view of the electromagnetic induction device according to a third preferred embodiment of the present invention.
Figure 8:
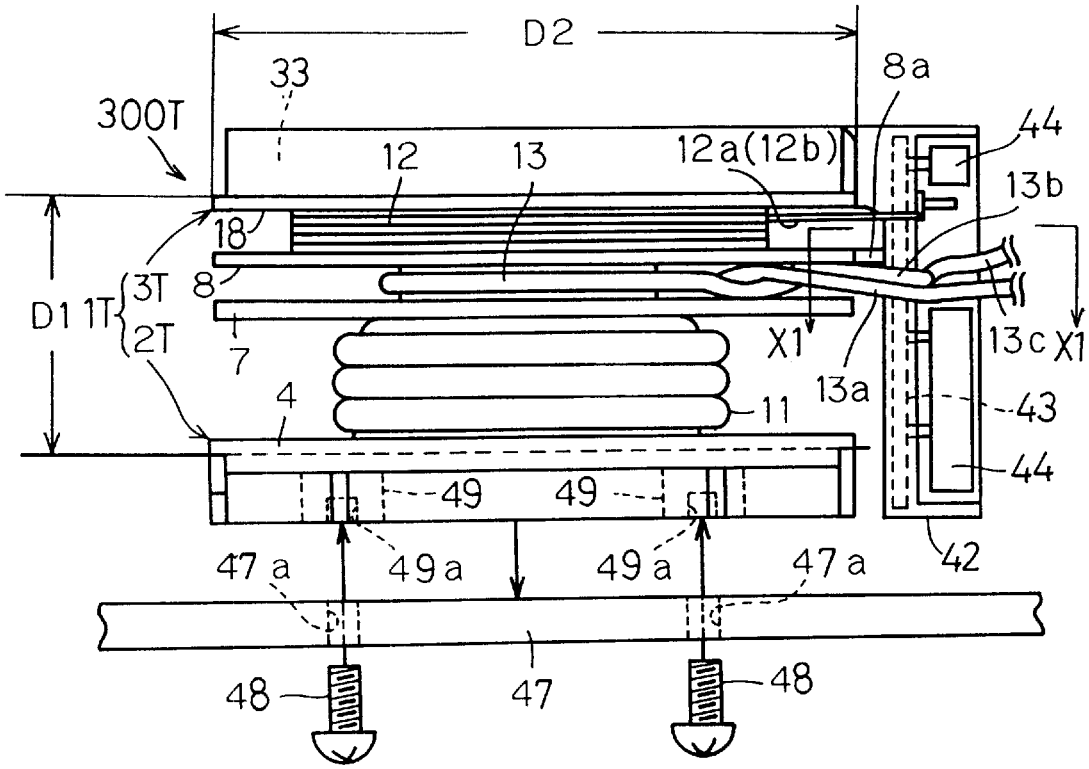
FIG. 8 is a front elevational view of the electromagnetic induction device shown in FIG. 7.
Figure 9:
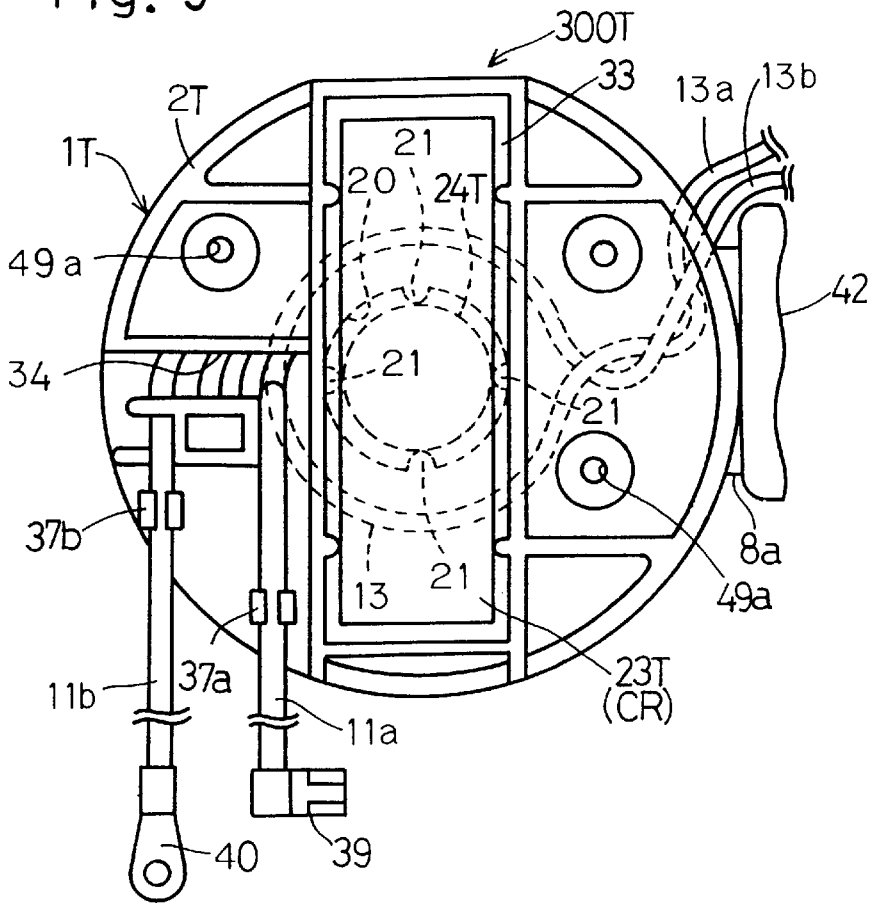
FIG. 9 is a bottom plan view of the electromagnetic induction device shown in FIG. 7.
Figure 10:
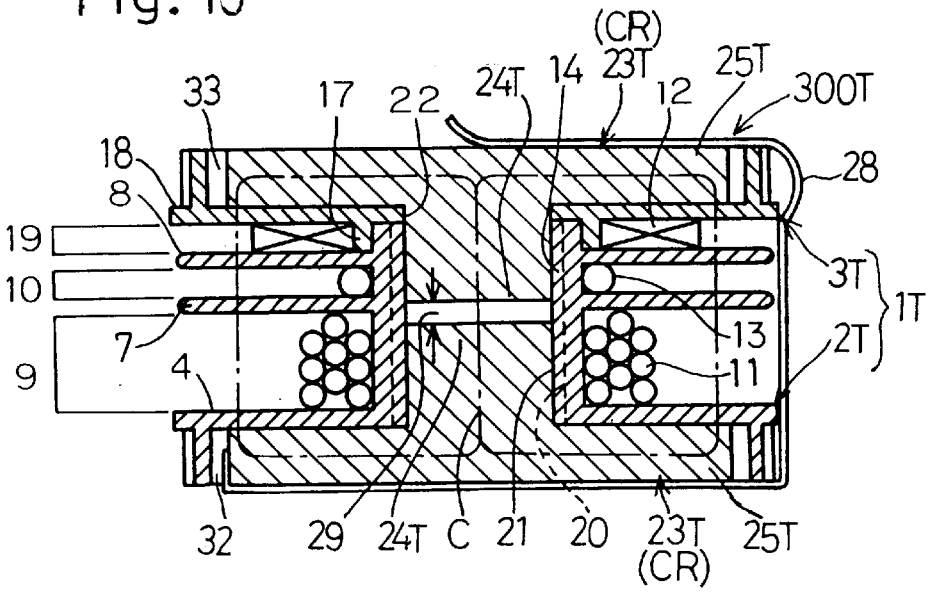
FIG. 10 is a cross-sectional view taken along the line X—X in FIG. 7.

The third preferred embodiment of the present invention is shown in FIGS. 7 to 11. As best shown in FIG. 10, the transformer 300T includes the core assembly CR made up of generally T-shaped first and second core pieces 23T and 23T. Referring to FIGS. 7 and 8, the fourth or top annular collar 18 integral with the second bobbin piece 3T positioned above the first bobbin piece 2T is provided at a portion of the outer periphery thereof with a substrate mount 42. This substrate mount 42 is formed integrally with that portion of the outer periphery of the fourth annular collar 18 so as to depend downwardly therefrom and so as to be positioned radially outwardly of the windings 11 to 13. At a location below the fourth annular collar 18, a support projection 8*a* formed integrally with a portion of an outer peripheral surface of the third annular collar 8 integral with the first bobbin piece 2T is held in contact with an inner side face of the substrate mount 42 thereby supporting the substrate mount 42.

The substrate mount 42 includes a secondary circuit substrate 43 fitted thereto. Specifically, in the illustrated embodiment, the secondary circuit substrate 43 is a printed circuit board having a printed pattern of circuits together with the half-wave rectifying circuit 65 shown in FIG. 27 and connecting lands of the electromagnetic induction device both associated with the secondary winding, and includes required electronic component parts 44 shown in FIG. 8 such as, for example, capacitors and diodes mounted thereon to thereby form a secondary high voltage circuit connected with the secondary winding. Accordingly, a primary low voltage circuit including the rectifying circuit 62 and the inverter 63 is formed on a primary circuit substrate (not shown) that is separate from the secondary circuit substrate 43 and positioned away from the transformer 300T. It is to be noted that the secondary circuit substrate 43 may have the full-wave rectifying circuit 67 shown in FIG. 28, in place of the half-wave rectifying circuit 65 shown in FIG. 27. The secondary circuit substrate 43 is fitted to and carried by the substrate mount 42 in an upright position, as viewed in FIG. 11, with its bottom resting on a support projection 45 formed integrally with a side wall of the substrate mount 42, while a catch pawl 46 formed integrally with a side wall of the substrate mount 42 is engaged to a side edge of a mounting surface of the secondary circuit substrate 43 to retain the latter in position.

The primary winding 11 shown in FIG. 8 has its opposite ends utilized as lead lines 11*a* and 11*b*, as best shown in FIG. 9, for electric connection with associated circuit elements of the primary circuit substrate by means of flag-shaped and eyeleted terminal members 39 and 40, respectively.

On the other hand, the secondary winding 12 shown in FIG. 8 has its opposite ends utilized respectively as lead lines 12*a* and 12*b* that are drawn outwardly towards the substrate mount 42 and are in turn soldered to associated connecting lands on the secondary circuit substrate 43. Accordingly, no pin terminal member such as the pin terminal members 41*a* and 41*b* (See FIG. 2) employed in the first embodiment of the present invention is employed in the second bobbin piece 3T. The heater winding 13 is formed by winding a heating wire in a single turn around as shown in FIG. 7, and within the heater winding frame 10 shown in FIG. 8 and has its opposite ends drawn outwardly towards the substrate mount 42 to define opposite lead lines 13*a* and 13*b*. The lead line 13*a* of the heater winding 13 is provided with a tab terminal member 51 shown in FIG. 11 for direct electric connection with the magnetron 66 (FIG. 27) whereas the other lead line 13*b* is soldered to a circuit element of the secondary circuit substrate 43. Also, the secondary circuit substrate 43 is provided with a connecting line 13*c* having one end fitted with a tab terminal member 51 for electric connection with the magnetron 66 and the opposite end electrically connected with the lead line 13*b* of the heater winding 13.

The transformer 300T according to this embodiment of the present invention is incorporated in the high frequency heating apparatus in the following manner. Specifically, as shown in FIG. 8, after the first bobbin piece 2T has been held in contact with an outer surface of a metallic housing 47 (made of, for example, stainless steel) of the high frequency heating apparatus, set screws 48 are inserted from interior of the housing 47 through associated through holes 47*a* defined in a wall of the housing 47 and are then fastened into associated screw holes 49*a* defined in mounting ribs 49 integral with the first bobbin piece 2T. At this time, the T-shaped core pieces 23T shown in Fig, 10 are electrically connected to the ground since the corresponding core arms 25T thereof are held in contact with the housing 47 directly or via the spring clip 28. Thereafter, the primary winding 11 is electrically connected with the primary circuit substrate by capping the flag-shaped terminal member 39 (See FIG. 7) onto a plate-shaped terminal member (not shown) provided on the primary circuit substrate (also not shown) and, at the same time, connecting the eyeleted terminal member 40 with a terminal socket (not shown) provided on the primary circuit substrate by the use of a set screw. Also, the tab terminal members 51 and 51 of the heater winding 13 are electrically connected with the magnetron.

Figure 11:
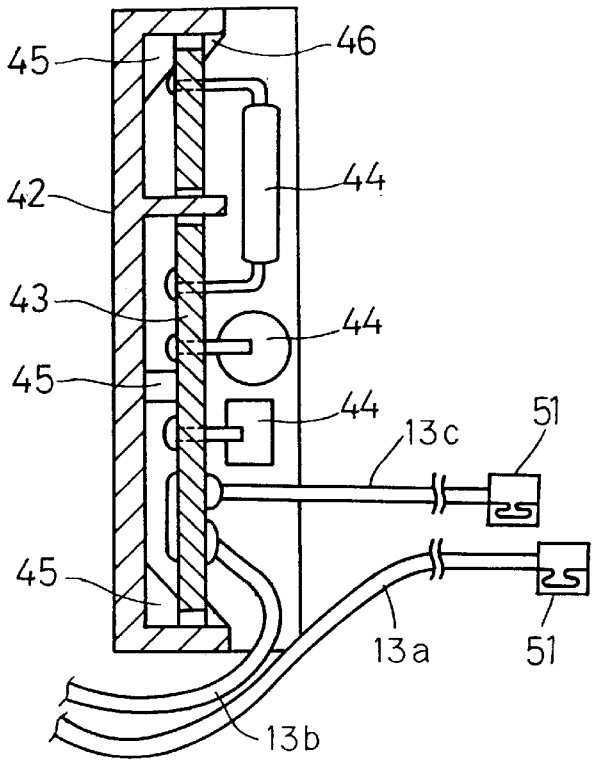
FIG. 11 is a cross-sectional view, on an enlarged scale, taken along the line XI—XI in FIG. 7.

As such, in addition to effects similar to those described in connection with the previous embodiments of the present invention, even the transformer 300T according to the third embodiment of the present invention can bring about additional effects. More specifically, since the transformer 300T is of a structure wherein the secondary winding 12 is connected to the integrally provided secondary circuit substrate 43, the transformer 300T can be mounted onto the high frequency heating apparatus in a form separated from the primary circuit substrate, with the lead lines 11*a* and 11*b* shown in FIG. 1 being connected subsequently, followed by connection of the lead line 13*a* of the heater winding 13 and the connecting line 13*c* as shown in FIG. 11. Thus, according to the third embodiment, the transformer 300T can be easily mounted in the high frequency heating apparatus.

Also, while in the transformer 300T the secondary circuit substrate 43 is fitted to a side portion of the bobbin 1T as shown in FIGS. 7 and 8, the overall size of the transformer 300T including the secondary circuit substrate 43 will not increase so much since the radial size D2 of the bobbin 1T is small as hereinbefore described. For this reason, the transformer 300T according to this embodiment can be installed at a relatively small space that may be chosen as desired from a vacant space available within the high frequency heating apparatus and, consequently, the high frequency heating apparatus can be assembled compact in size.

In addition, since the primary circuit substrate has no transformer mounted thereon and can therefore have a relatively small size, the cost required for the substrate can be reduced. Also, since the primary circuit substrate is separated from the secondary circuit substrate 43 in which a high voltage is generated, a sufficient insulation distance can be secured therebetween. Moreover, the core pieces 23T can be grounded by bringing them into direct contact with the housing 47 of the high frequency heating apparatus, thereby eliminating the need to use separate component parts for grounding the core pieces 23T.

(Fourth Preferred Embodiment)

Figure 12:
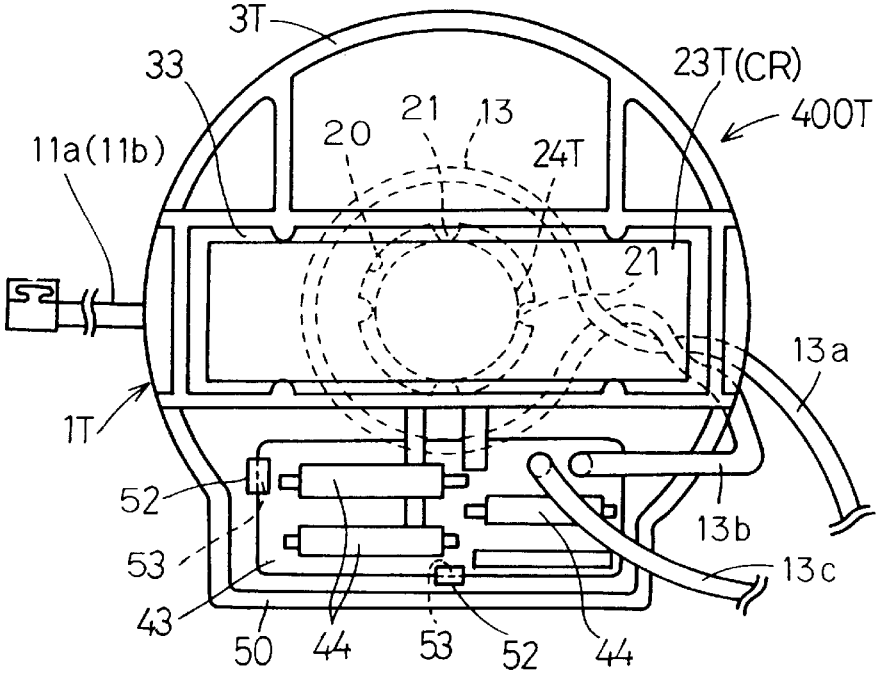
FIG. 12 is a top plan view of the electromagnetic induction device according to a fourth preferred embodiment of the present invention.
Figure 13:
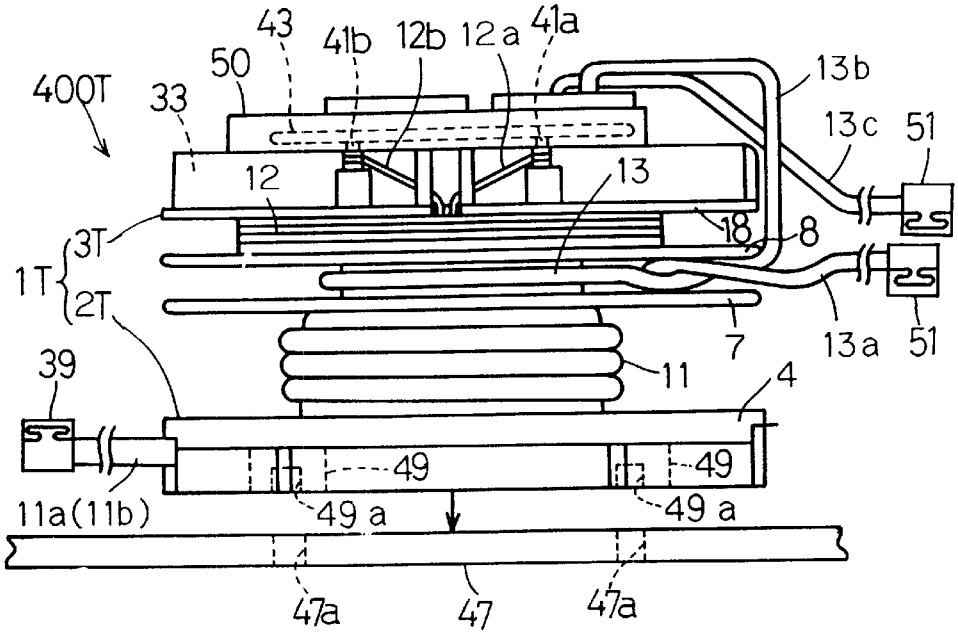
FIG. 13 is a front elevational view of the electromagnetic induction device shown in FIG. 12.

FIGS. 12 and 13 illustrates the transformer 400T according to a fourth preferred embodiment of the present invention. Even the transformer 400T makes use of the core assembly CR made up of the generally T-shaped first and second core pieces 23T and 23T. However, the transformer 400T differs from the transformer 300T of the previously described third embodiment in that in the fourth embodiment a substrate mount 50 shown in FIG. 12 is formed integrally with the second bobbin piece 3T (See FIG. 13) so as to protrude a slight distance forwards from an upper surface thereof and, also, in that the starting and terminating lead lines 12*a* and 12*b* of the secondary winding 12 are turned around and then soldered to respective pin terminals 41*a* and 41*b* that are fixedly implanted in the second bobbin piece 3T so as to protrude axially thereof.

The secondary circuit substrate 43 is, as is the case with the previously described third embodiment, fitted to and carried by the substrate mount 50 with its bottom resting on support projections (not shown) formed integrally with a bottom surface of the substrate mount 50, while catch pawl 53 at respective free ends of ribs 52 formed on the bottom surface of the substrate mount 50 so as to protrude upwardly therefrom as shown in FIG. 12 are engaged to associated side edges of a mounting surface of the secondary circuit substrate 43 to retain the latter in position. Also, the heater winding 13 is formed by winding a heating wire in a single turn around and within the heater winding frame 10 shown in FIG. 15 and has its opposite ends defining respective lead lines 13*a* and 13*b*. The lead line 13*a* of the heater winding 13 is electrically connected directly with the magnetron through a tab terminal member 51 whereas the other lead line 13*b* is, after having been drawn outwardly and upwardly, soldered to a circuit element of the secondary circuit substrate 43. Also, a connecting line 13*c* fitted to the secondary circuit substrate 43 while being electrically connected with the lead line 13*b* is adapted to be connected with the magnetron through the tab terminal member 51.

Accordingly, in addition to effects similar to those described in connection with the previously described third embodiment of the present invention, even the transformer 400T according to the fourth embodiment of the present invention can bring about additional effects. More specifically, since the bobbin 1T used in the transformer 400T, which has a relatively small axial width, has the substrate mount 50 provided integrally on the upper surface thereof, the radial size of the transformer 400T including the substrate mount 50 can be reduced and, accordingly, when the transformer 400T is to be incorporated in the high frequency heating apparatus, the transformer 400T can be installed at a relatively small space.

(Fifth Preferred Embodiment)

Figure 14:
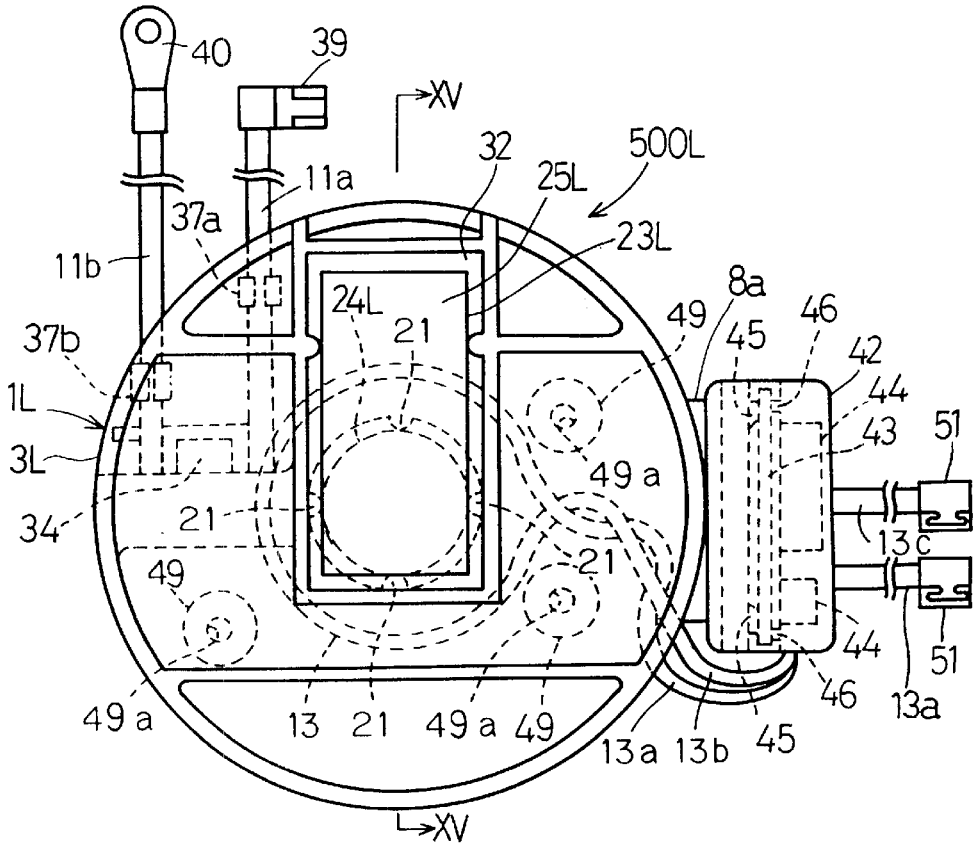
FIG. 14 is a top plan view of the electromagnetic induction device according to a fifth preferred embodiment of the present invention.
Figure 15:
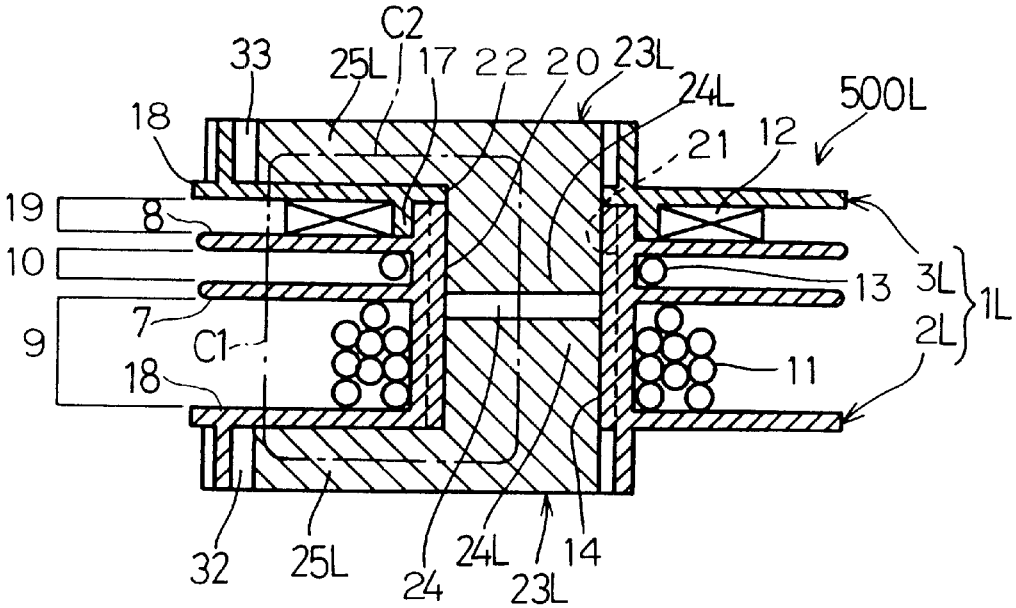
FIG. 15 is a cross-sectional view taken along the line XV—XV in FIG. 14.

FIGS. 14 and 15 illustrates the transformer 500L according to a fifth preferred embodiment of the present invention. This transformer 500L shown therein makes use of the core assembly CR made up of generally L-shaped first and second core pieces 23L and 23L in place of the T-shaped first and second core pieces 23T and 23T used in the third and fourth embodiments of the present invention, other structural features of which are substantially similar to those in the previously described third embodiment.

As shown in FIG. 14, the first and second core pieces 23L and 23L are inserted respectively into the throughholes 20 and 22 in the first and second bobbin pieces 2L and 3L forming the bobbin 1L of the same shape as that in the previously described second embodiment. The substrate mount 42 is formed integrally with the second bobbin piece 3L and is positioned laterally of the bobbin 1L and radially outwardly of the windings 11 and 12. As shown in FIG. 15, respective free ends of the core arms 25L and 25L of the first and second core pieces 23L and 23L are positioned radially outwardly of the outermost perimeter of each of the windings 11 to 13. Even this transformer 500L is so designed that the coupling coefficient between the primary and secondary windings 11 and 12 can have a value within the range of 0.6 to 0.8.

Even in this fifth embodiment, the first and second core pieces 23L and 23L are of the same shape and dimensions, but they may have different shapes and dimensions and, in particular, the respective core legs 24L and 24L of those first and second core pieces 23L and 23L may have different lengths. Also, the substrate mount 42 may be formed integrally with the second bobbin piece 3L and positioned axially outwardly of the windings 11 and 12 as is the case with the previously described fourth embodiment.

(Sixth Preferred Embodiment)

The transformer 600T according to a sixth preferred embodiment of the present invention will now be described with reference to FIGS. 16 to 20. Even this transformer 600T of a flat configuration having the axial width D1 of the bobbin 1T that is smaller than the radial size D2 thereof as shown in FIG. 19. In describing the transformer 600T, only the difference between it and the transformer 100T according to the first embodiment will be described.

Figure 18:
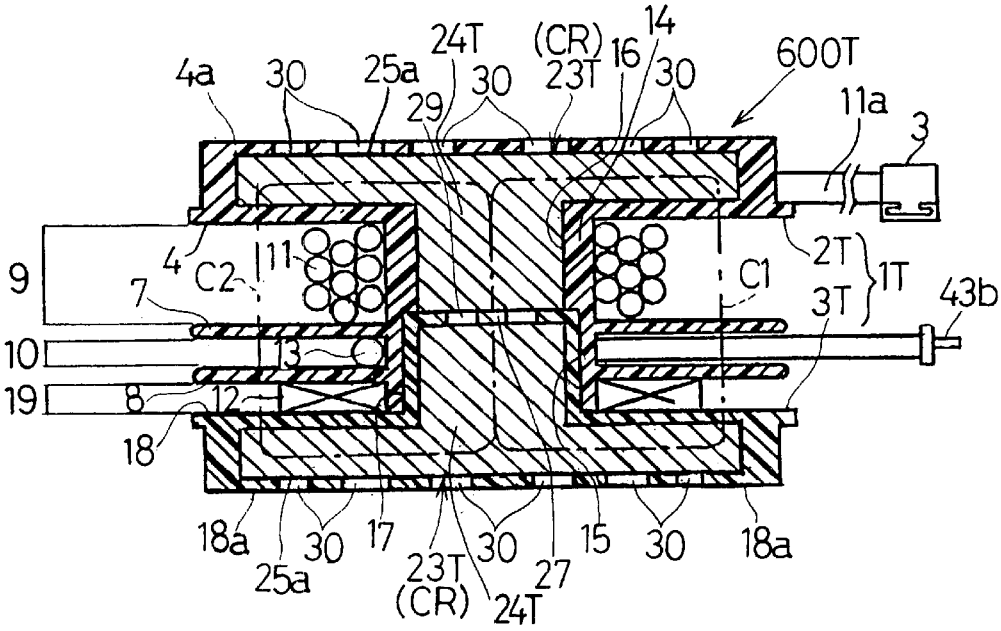
FIG. 18 is a longitudinal sectional view of the electromagnetic induction device shown in FIG. 16.
Figure 19:
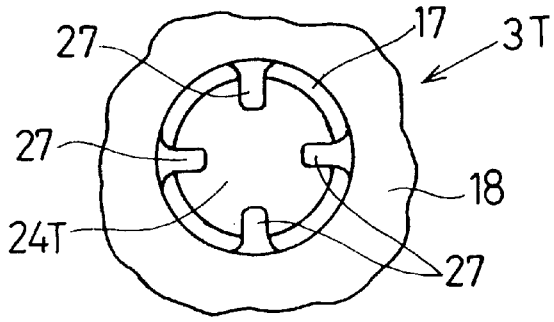
FIG. 19 is a top plan view of a portion of the electromagnetic induction device shown in FIG. 16.
Figure 20:
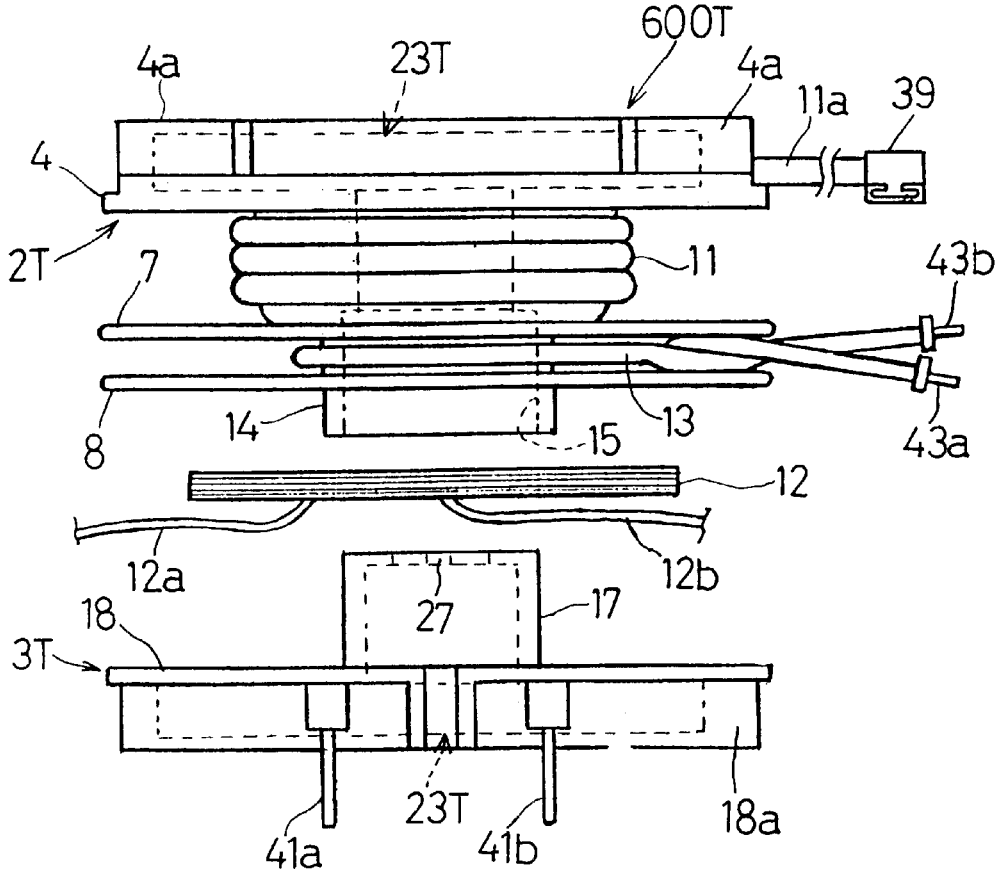
FIG. 20 is an exploded view of the electromagnetic induction device shown in FIG. 16.

Referring now to FIG. 18, the generally T-shaped first and second core pieces 23T and 23T of the same shape and size which form the core assembly CR are embedded in the first and second bobbin pieces 2T and 3T by the use of an insert-molding technique., respectively. More specifically, each of the first and second core pieces 23T and 23T is of a structure in which the associated core arm 25T is embedded in a disc-shaped end frame 4*a* or 18*a* which defines an outer shell of the corresponding bobbin piece 2T or 3T whereas the associated core leg 24T is embedded in the cylindrical hollow body 14 or 17 of the corresponding bobbin piece 2T or 3T.

The respective core arms 25T and 25T of the first and second core pieces 23T and 23T extend parallel to each other in a direction radially of the windings 11 to 13 while being held in face-to-face relation with each other. A free end of the core leg 24T of the first core piece 23T embedded in the first bobbin piece 2T is aligned with a starting end of a large diametric inner peripheral surface 15 (i.e., a step between inner peripheral surfaces 15 and 16). The hollow cylindrical body 17 of the second bobbin piece 3T has its inner peripheral surface formed with a plurality of, for example, four spacers 27 in the form of a projection so as to protrude radially inwardly from an open end edge at a free end of such hollow cylindrical body 17 as best shown in FIG. 19. These spacers 27 are spaced 90° from each other in a circumferential direction of the hollow cylindrical body 17. The sum of the length of the hollow cylindrical body 17 and the thickness of the spacers 27 is so chosen as to be equal to the axial width of the large diametric inner peripheral surface 15 of the first bobbin piece 2T as shown in FIG. 18.

Accordingly, when the hollow cylindrical body 17 of the second bobbin piece 3T is completely inserted into the large diametric inner peripheral surface 15 of the hollow cylindrical body 14 of the first bobbin piece 2T, the spacers 27 intervene between the respective free end faces of the core legs 24T and 24T of the first and second core pieces 23T and 23T to thereby form a gap 29 of a size determined by the thickness of the spacers 27. In this way, the coupling coefficient between the primary and secondary windings 11 and 12 is set to a value within the range of 0.6 to 0.8.

Figure 16:
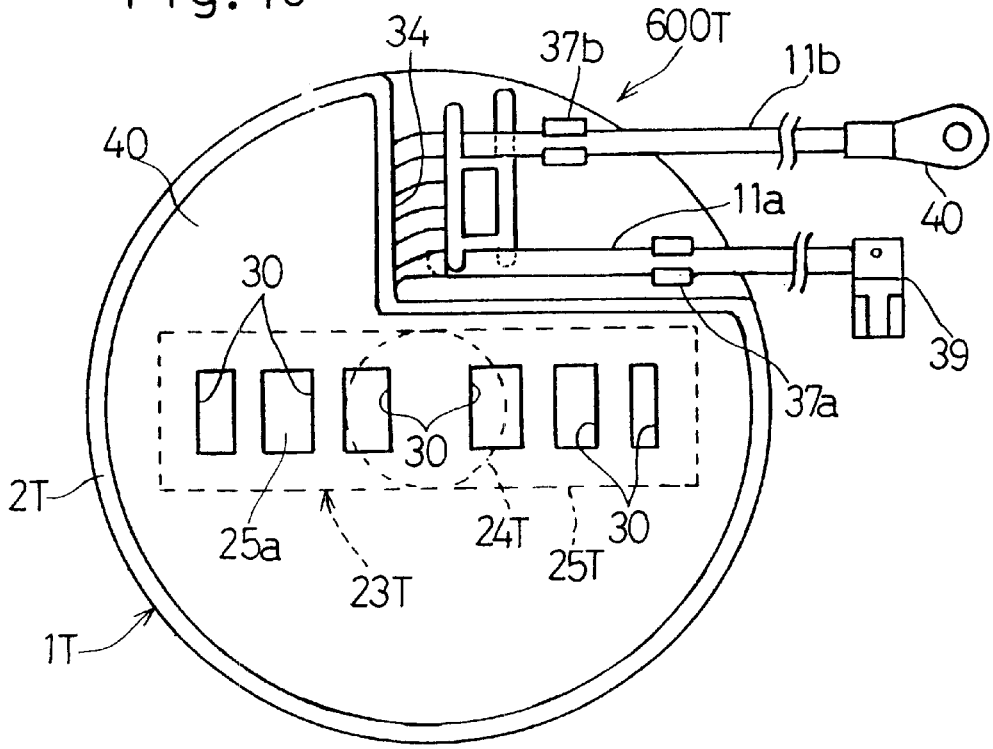
FIG. 16 is a top plan view of the electromagnetic induction device according to a sixth preferred embodiment of the present invention.
Figure 17:
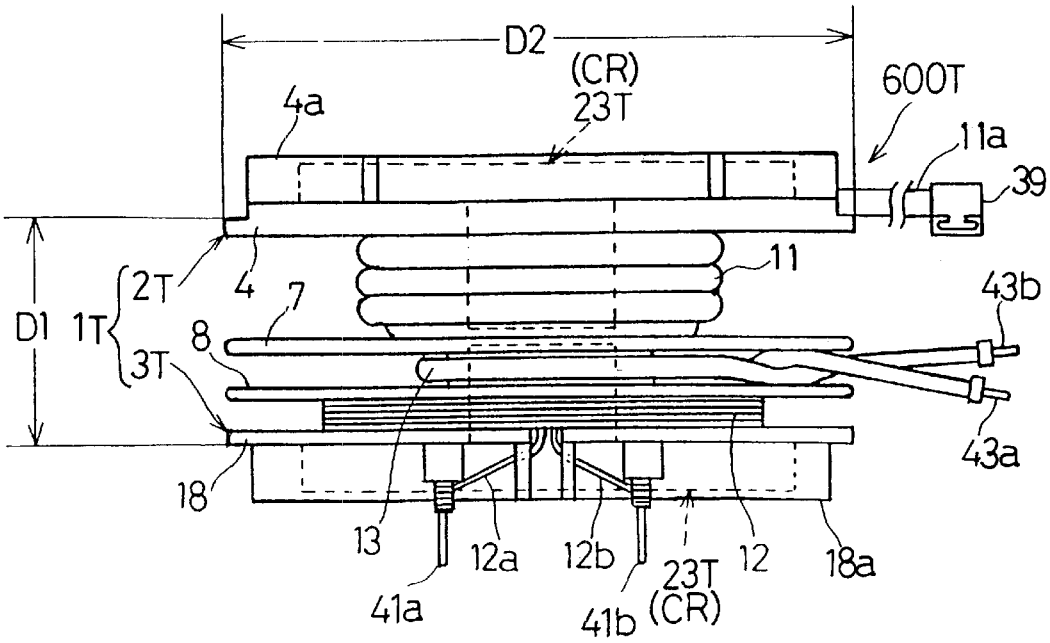
FIG. 17 is a front elevational view of the electromagnetic induction device shown in FIG. 16.

An outer end face of each of the disc-shaped end frames 4*a* and 18*a* of the associated bobbin pieces 2T and 3T is formed with a plurality of heat radiating vent holes 30, as shown in FIG. 16, through which a portion of the core piece 23T, that is, a portion of a top face 25*a* of the core arm 25T where no core leg such as 24T is formed is exposed to the outside. At the time the transformer 600T is electrically energized, heat evolved from the first and second core pieces 23T and 23T can be satisfactorily and effectively discharged to the outside of the bobbin pieces 2T and 3T through the heat radiating vent holes 30.

Accordingly, even the transformer 600T can being about, in addition to the effects similar to those discussed in connection with the first embodiment of the present invention, such an effect that the number of component parts is reduced since the first and second core pieces 23T and 23T are integrated together with the first and second bobbin pieces 2T and 2T, respectively, and, therefore, not only can the number of manufacturing steps be reduced, but the manufacturing cost can also be reduced.

(Seventh Preferred Embodiment)

Figure 21:
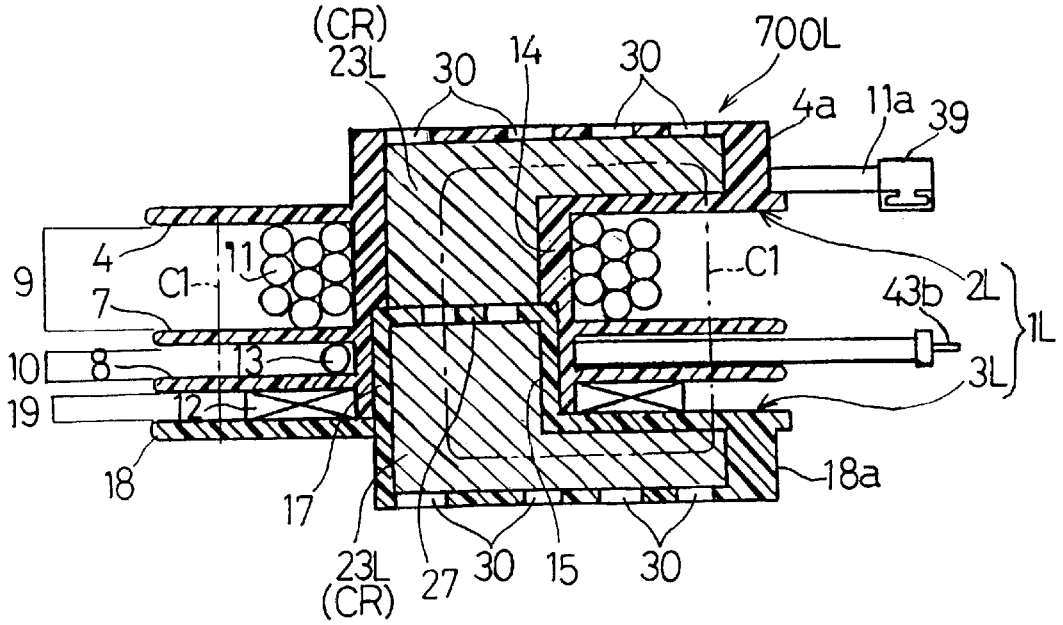
FIG. 21 is a longitudinal sectional view of the electromagnetic induction device according to a seventh preferred embodiment of the present invention.

A seventh preferred embodiment of the present invention will now be described with reference to FIG. 21. The transformer identified by 700L according to this embodiment differs from the transformer 600T according to the previously described sixth embodiment in that in place of the bobbin 1T employed in the sixth embodiment the bobbin 1L is employed and also in that in place of the core assembly CR made up of the T-shaped first and second core pieces 23T and 23T in the sixth embodiment, the bobbin assembly CR made up of the L-shaped first and second core pieces 23L and 23L shown in FIG. 6B are employed. Other structural features are substantially similar to those in the sixth embodiment. As is the case with the sixth embodiment, each of the first and second core pieces 23L and 23L is of a structure in which the associated core arm 25L is embedded in the end frame 4*a* or 18*a* of the associated bobbin piece 2L or 3L whereas the associated core leg 24L is embedded in the cylindrical hollow body 14 or 17 of the corresponding bobbin piece 2L or 3L as shown in FIG. 21 by the use of an insert-molding technique. As such, as is the case with the sixth embodiment, the seventh embodiment is advantageous in that not only the number of component parts but also the number of manufacturing steps can be reduced.

(Eighth Preferred Embodiment)

Figure 22:
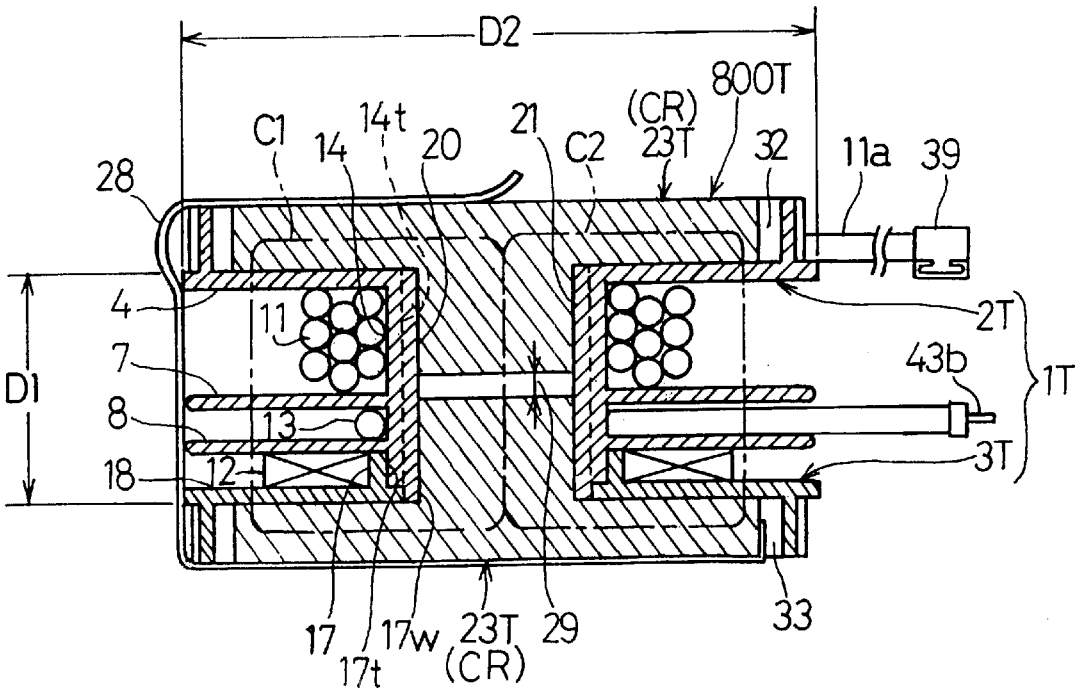
FIG. 22 is a longitudinal sectional view of the electromagnetic induction device according to an eighth preferred embodiment of the present invention.
Figure 23:
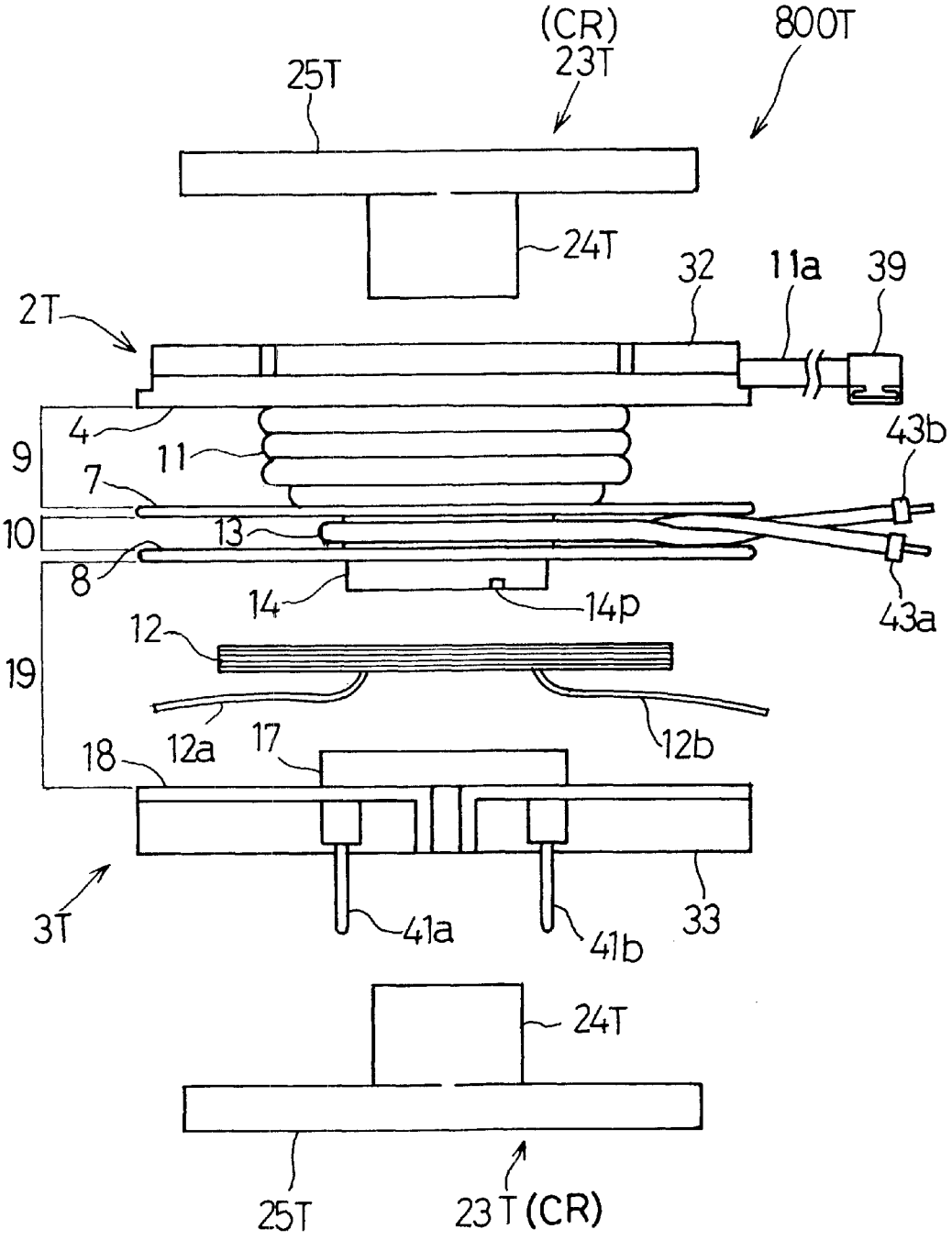
FIG. 23 is an exploded view of the electromagnetic induction device shown in FIG. 22.

Shown in FIGS. 22 to 24 is the transformer 800T according to an eighth preferred embodiment of the present invention. This transformer 800T when viewed in a top plan view and also in a front elevational view is similar to that shown in FIGS. 1 and 2 both associated with the previously described first embodiment of the present invention and, therefore, the details thereof are reiterated for the sake of brevity.

Figure 24A:
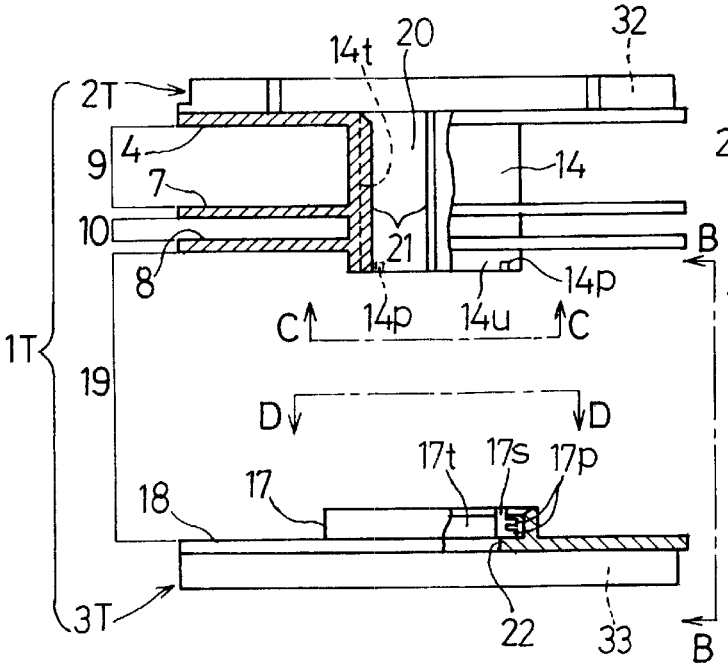
FIG. 24A is a fragmentary exploded view of a portion of the electromagnetic induction device shown in FIG. 22, showing the bobbin.

Referring to FIG. 24A, the bobbin 1T shown therein is axially divided so as to be constituted by the first bobbin piece 2T and the second bobbin piece 3T having the hollow cylindrical body 17 of a relatively small length into which the hollow cylindrical body 14 of a relatively large length formed integrally with the first bobbin piece 2T is inserted. The hollow cylindrical body 14 of the first bobbin piece 2T is integrally formed with the first annular collar 4 protruding radially outwardly from one end thereof, the second annular collar 7 protruding radially outwardly from an intermediate portion thereof and lying parallel to the first annular collar 4, and the third annular collar 8 protruding radially outwardly from the opposite end thereof and lying parallel to any one of the first and second annular collar 4 and 7. A space between the first and second annular collars 4 and 7 defines the primary winding frame 9 and a space between the second and third annular collars 7 and 8 defines the heater winding frame 10.

Figure 24B:
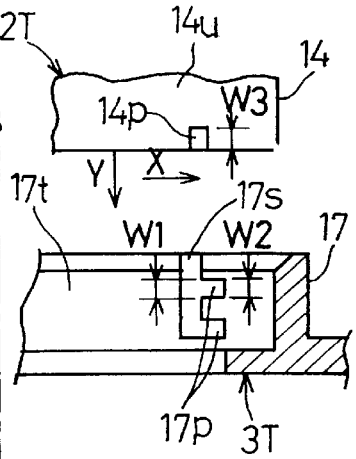
FIG. 24B is a fragmentary exploded view of the bobbin shown in FIG. 24A, showing an engagement projection and a guide groove both formed therein in an enlarged scale.
Figure 24C:
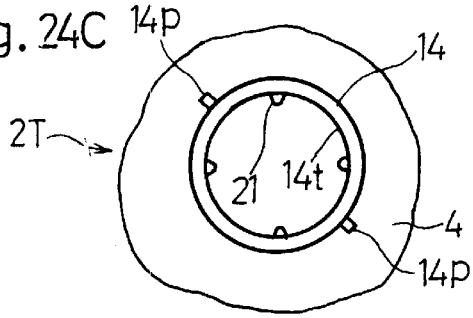
FIG. 24C is a fragmentary bottom plan view of a portion of the bobbin shown in FIG. 24A, as viewed along the line C—C in FIG. 24A.

An inner peripheral surface 14*t* of the hollow cylindrical body 14 forming the throughhole 20 in the first bobbin piece 2T is formed with a plurality of, for example, four guide ribs 21 so as to protrude radially inwardly therefrom and also so as to be spaced 90° from each other in the circumferential direction thereof as shown in FIGS. 24A and 24B, whereas a free end of an outer peripheral surface 14*u* of the hollow cylindrical body 14 is formed with two engagement projections 14*p* so as to protrude radially outwardly and so as to be spaced 180° from each other in the circumferential direction thereof. On the other hand, as shown in FIG. 24A, the hollow cylindrical body 17 of the second bobbin piece 3T is integrally formed with the fourth annular collar 18 so as to protrude radially outwardly from one end thereof.

Figure 24D:
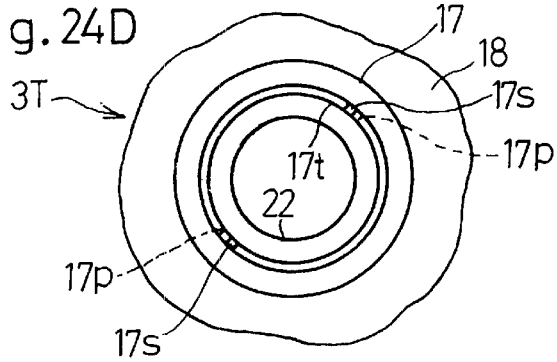
FIG. 24D is a fragmentary top plan view of a portion of the bobbin shown in FIG. 24A, as viewed along the line D—D in FIG. 24A.

As shown in FIGS. 24A and 24D, an inner peripheral surface 17*t* of the hollow cylindrical body 17 of the second bobbin 3T is formed with two axially extending guide grooves 17*s* spaced 180° from each other in the circumferential direction thereof and also with two axially spaced engagement grooves 17*p* communicated with the guide grooves 17*s* and extending in the circumferential direction thereof As best shown in FIG. 24B, each of the engagement grooves 17*p* is so sized that the width WI of an opening thereof that is communicated with the adjacent axially extending guide groove 17*s* can be slightly smaller than the width W3 of the corresponding engagement projection 14P and the width W2 of an annular bottom of the respective engagement groove 17P can be substantially equal to the width W3. When the hollow cylindrical body 14 of the first bobbin piece 2T is to be inserted into the hollow cylindrical body 17 of the second bobbin piece 3T to complete the bobbin 1T, the hollow cylindrical body 14 is inserted into the hollow cylindrical body 17 with the engagement projections 14*p* guided along the associated guide grooves 17*s* in an axial direction shown by the arrow Y until the engagement projections 14*p* are aligned with the desired engagement grooves 17*p* and, thereafter, the first bobbin piece 2T is turned a predetermined angle in a predetermined direction shown by the arrow X relative to the second bobbin piece 3T to bring the engagement projections 14*p* into engagement with the associated engagement grooves 17*p*. It is to be noted that as the engagement projections 14*p* are brought into engagement with the respective engagement grooves 17*p* in the manner described above, respective portions of each engagement projection 14*p* and each engagement groove 17*p* then brought into abutment with each other undergo elastic deformation. In this way, the engagement projections 14*p* once engaged into the associated engagement grooves 17*p* will no longer separate therefrom and, unless a turning force necessary to turn the first bobbin piece 2T in a direction reverse to the direction shown by the arrow X relative to the second bobbin piece 3T is applied, the engagement projections 14*p* cannot separate from the respective engagement grooves 17*p*.

As shown in FIG. 23, the primary winding 11 prepared from a relatively thick electric wire is cylindrically wound around and mounted on the primary winding frame 9 in the first bobbin piece 2T. Also, the heater winding 13 having a small number of turns is would around and mounted on the heater winding frame 10 in the first bobbin piece 2T.

The first bobbin piece 2T carrying the primary winding 11 and the heater winding 13 wound therearound and the second bobbin piece 3T are connected and assembled together as shown in FIG. 22 to thereby complete the bobbin 1T. In this assembled condition, the secondary winding frame 19 shown in FIG. 23 defining a winding groove is defined between the third annular collar 8 of the first bobbin piece 2T and the fourth annular collar 18 of the second bobbin piece 3T while straddling between the first and second bobbin pieces 2T and 3T, with the secondary winding 12 subsequently mounted within the secondary winding frame 10. This secondary winding 12 is in the form of a uniformly layered annular coil block having a plurality of layers of a multiplicity of turns of an enameled electric wire caked together and prepared in the same manner as described above with the first embodiment. The uniformly layered annular coil block is then mounted onto the hollow cylindrical body 17 of the second bobbin piece 3T so as to rest on the fourth annular collar 18 and the hollow cylindrical body 14 of the first bobbin piece 2T is subsequently inserted into the hollow cylindrical body 17 of the second bobbin piece 3T to thereby complete assemblage of the bobbin 1T. It is, however, to be noted that the secondary winding 12 may be wound around and within the secondary winding frame 10 after assemblage of the bobbin 1T has completed.

The core assembly CR made up of the T-shaped first and second core pieces 23T and 23T is inserted and fitted to the bobbin 1T after the latter has been assembled in the manner described above, with the first and second core pieces 23T and 23T accommodated snugly within the respective core chambers 32 and 33 that are formed in the first and second bobbin pieces 23T and 23T. Each of the core chambers 32 and 33 is in the form of a recess defined by upright walls formed on the first annular collar 4 of the first bobbin piece 2T or the fourth annular collar 18 of the second bobbin piece 3T so as to protrude therefrom and surround opposite side faces and one end face of the corresponding core arm 25T of the respective core piece 23T. The free end portion of the core arm 25T of each core piece 23T protrudes radially outwardly from the outer perimeter of any one of the windings 11 to 13. As such, the coupling coefficient between the primary and secondary windings 11 and 12 is set to a value within the range of 0.6 to 0.8.

After the first and second bobbins pieces 2T and 3T are coupled together in the manner described above to complete the bobbin 1T, the lead lines 12*a* and 12*b* in FIG. 23 at the opposite ends of the secondary winding 12 are would around and then soldered to respective pin terminal members 41*a* and 41*b* that are implanted into the second bobbin piece 3T so as to protrude axially therefrom. Then, as shown in FIG. 22, along the guide ribs 21 that are formed on the inner peripheral surface 14*t* of the hollow cylindrical body 14 of the first bobbin piece 2T, the core legs 24T and 24T of the T-shaped first and second core pieces 23T and 23T of the same shape and size are inserted from opposite open ends of the throughhole 20 in the bobbin 1T, that is, an open end of the hollow cylindrical body 14 of the first bobbin piece 2T and an opening 17*w* formed in the fourth annular collar 18 of the second bobbin piece 3T, respectively, with the core legs 24T and 24T consequently positioned radially inwardly of the windings 11 and 12.

Thereafter, the U-shaped spring clip 28 is mounted to apply axially urging forces externally to the first and second core pieces 23T and 23T in a direction close towards each other to thereby firmly retain the first and second core pieces 23T and 23T in position sandwiched by the spring clip 28. At this time, the cylindrical core legs 24T and 24T of the T-shaped first and second core pieces 23T and 23T are held in face-to-face relation with each other with the gap 29 formed between the respective free end faces thereof. This gap 29 is positioned within the hollow cylindrical body 14 of the first bobbin piece 2T at a location substantially intermediate between the primary and secondary windings 11 and 12. It is to be noted that while the gap 29 may have a suitably chosen gap size, this gap 29 may be zero in size, that is, the respective end faces of the core legs 24T and 24T may be held in contact with each other.

With the structure described above, by selectively engaging the engagement projections 14*p* of the first bobbin piece 2T with one of the two engagement grooves 17*p* of the second bobbin piece 3T, the groove width of the winding groove defining the secondary winding frame 19 as measured in a direction axially of the bobbin 1T varies. Accordingly, while utilizing the common bobbin pieces 2T and 3T, changing the winding width of the secondary winding 12 as measured in a direction axially of the bobbin 1T and then changing the number of turns of the secondary winding 12, characteristics of the transformer 800 such as a transfer factor and others can be changed.

(Ninth Preferred Embodiment)

Figure 25A:
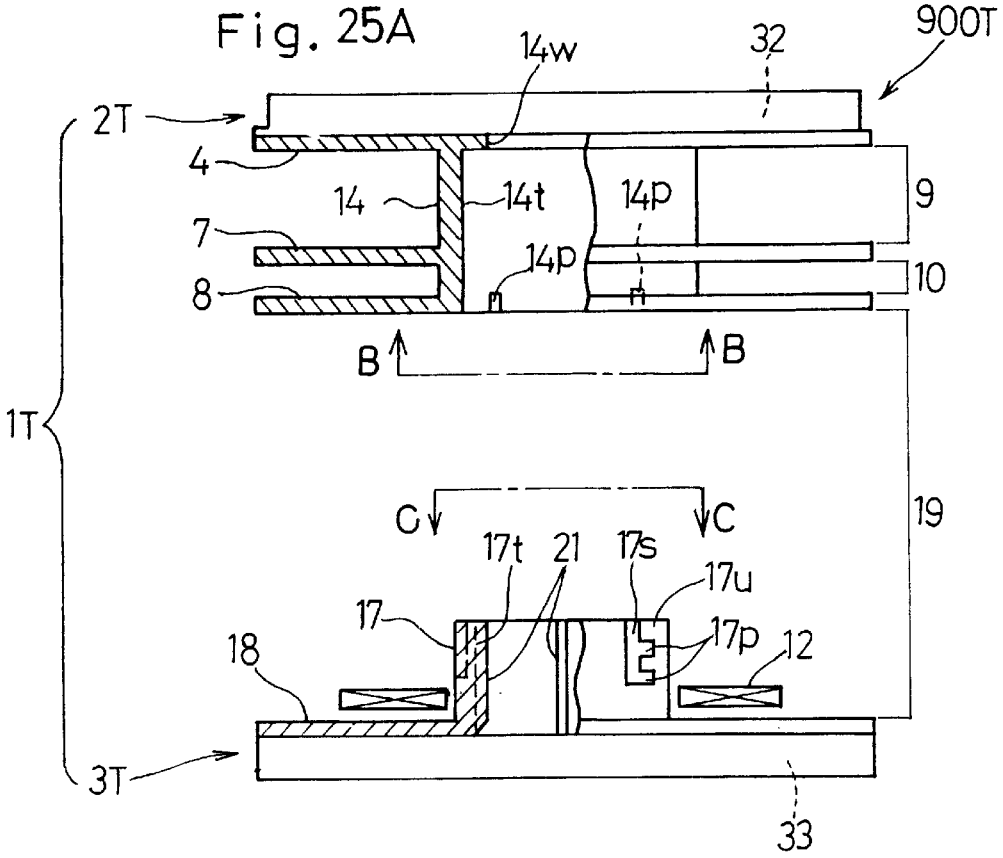
FIG. 25A is an exploded view, with a portion shown in section, of the bobbin employed in the electromagnetic induction device according to a ninth preferred embodiment of the present invention.
Figure 25B:
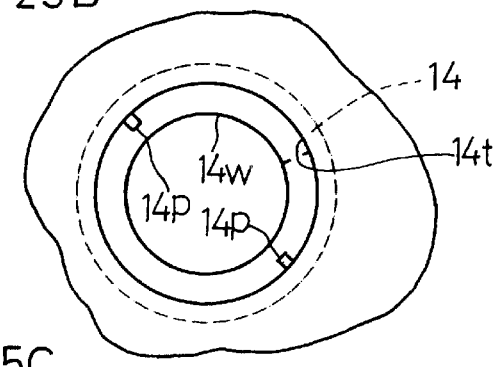
FIG. 25B is a fragmentary bottom plan view of the bobbin as viewed along the line B—B in FIG. 25A.
Figure 25C:
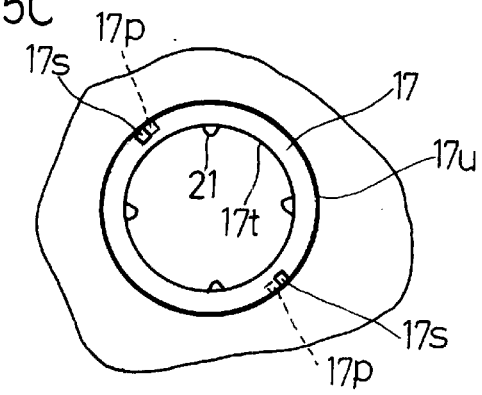
FIG. 25C is a fragmentary top plan view of the bobbin as viewed along the line C—C in FIG. 25A.

FIGS. 25A to 25C illustrates a ninth preferred embodiment of the present invention in which the bobbin 1T employed in the transformer 800T according to the foregoing eighth embodiment is modified. While in the previously described eighth embodiment the hollow cylindrical body 14 of the first bobbin piece 2T shown in FIG. 24A has been described as inserted into the hollow cylindrical body 17 of the second bobbin piece 3T, the ninth embodiment is such that the first and second bobbins 2T and 3T are coupled together in a manner substantially reverse to that accomplished in the eighth embodiment. More specifically, as shown in FIG. 25A, the hollow cylindrical body 17 of the second bobbin piece 3T is inserted into the hollow cylindrical body 14 of the first bobbin piece 2T. For this purpose, the inner peripheral surface 14*t* of the hollow cylindrical body 14 of the first bobbin piece 2T is formed with the engagement projections 14*p* so as to protrude radially inwardly therefrom and so as to be spaced 180° from each other in the circumferential direction thereof On the other hand, the inner peripheral surface 17*t* of the hollow cylindrical body 17 of the second bobbin piece 3T defining the throughhole in the bobbin 1T is formed with the guide ribs 21 so as to be spaced 90° from each other in the circumferential direction thereof whereas the outer peripheral surface 17*u* thereof is formed with the guide grooves 17*s* and the engagement grooves 17*p*. An opening 14*w* defined in the first annular collar 4 of the first bobbin piece 2T serves to receive the core leg of the corresponding core piece.

Even in this embodiment, as is the case with the eighth embodiment described previously, after the secondary winding 12 is mounted on the hollow cylindrical body 17 of the second bobbin piece 3T so as to rest on the fourth annular collar 18, the hollow cylindrical body 17 of the second bobbin piece 3T is inserted into the hollow cylindrical body 14 of the first bobbin piece 2T to connect the first and second bobbin pieces 2T and 3T together in a manner substantially similar to that in the first embodiment and, thereafter, the lead lines of the respective windings 11 to 13 are processed and connected with the associated terminal members in a manner similar to those described previously, followed by mounting of the generally U-shaped spring clip 28 to retain the first and second T-shaped core pieces 23T and 23T shown in FIG. 23 in the assembled condition.

It is clear that even the ninth embodiment can bring about effects similar to those afforded by the previously described eighth embodiment.

(Tenth Preferred Embodiment)

Figure 26:
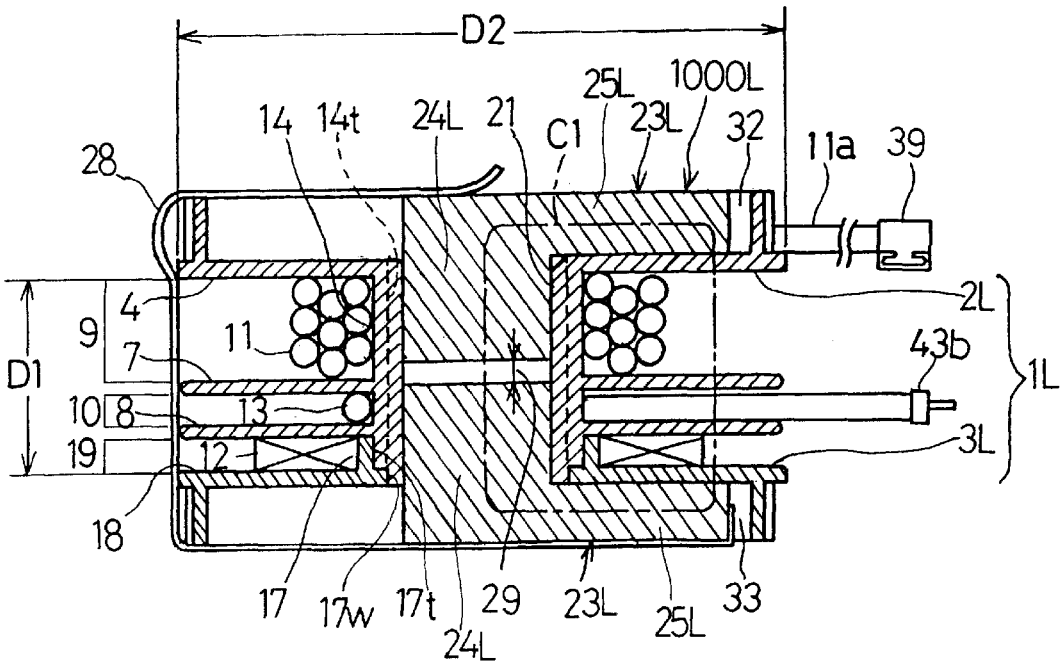
FIG. 26 is a longitudinal sectional view of the electromagnetic induction device according to a tenth preferred embodiment of the present invention.

The transformer 1000L according to the tenth preferred embodiment of the present invention is shown in FIG. 26. Other than the use of the core assembly CR made up of the generally L-shaped first and second core pieces 23L and 23L, the transformer 1000L is substantially similar to that according to the eighth embodiment described hereinbefore.

Referring now to FIG. 26, the first and second core pieces 23L and 23L are inserted into the hollow cylindrical bodies 14 and 17 of the first and second bobbin pieces 2L and 3L forming the bobbin 1T, respectively. The respective free end portions of the core arms 25L of the first and second core pieces 23L and 23L are positioned radially outwardly of the windings 11 to 13.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. By way of example, although in any one of the previously described eighth, ninth and tenth embodiments of the present invention, the width of the secondary winding frame 19 as measured in the axial direction of the bobbin 1T or 1L has been changed, the width of the primary winding frame 9 can be changed if the primary and secondary windings 11 and 12 are reversed in position.

Also, if the bobbin 1 T or 1L is divided into three or more component parts, two or more winding frames each having a variable width can be formed between each adjoining bobbin pieces.

The present invention although having been described as applied to the transformer for use in driving the magnetron can be equally applied to any other electromagnetic induction device such as, for example, a choke coil or a reactor and, accordingly, such changes and modifications are, unless they depart from the scope of the present invention as delivered from the claims annexed hereto, to be construed as included therein.

What is claimed is:

1. An electromagnetic induction device which comprises:

a core assembly for defining a magnetic circuit, said core assembly including T-shape or L-shape first and second core pieces;

a substantially flat bobbin having an axial width and a radial size, the axial width being smaller than the radial size, said bobbin having a bore defined therein so as to extend in an axial direction of the bobbin; and a winding member mounted on the bobbin;

wherein core legs of the first and second core pieces are inserted into the bore of the substantially flat bobbin while core arms of the first and second core pieces extend parallel to each other.

2. The electromagnetic induction device as claimed in claim 1, wherein the winding member includes primary and secondary windings mounted on the bobbin in axially spaced relation to each other and wherein respective free ends of the core legs of the first and second core pieces confront with each other to define a gap therebetween.

3. The electromagnetic induction device as claimed in claim 2, wherein a coupling coefficient between the primary and secondary windings is set to a value within the range of 0.6 to 0.8.

4. The electromagnetic induction device as claimed in claim 1, wherein the winding member includes primary and secondary windings mounted on the bobbin in axially spaced relation to each other;

wherein the primary winding has lead lines extending from respective opposite ends thereof, each of said lead lines of the primary winding being fitted with a terminal member capable of being connected with a terminal piece, mounted on a circuit substrate, by screwing or insertion, and wherein the secondary winding has opposite ends connected with respective pin terminals fixedly secured to the bobbin and capable of being inserted into the circuit substrate.

5. The electromagnetic induction device as claimed in claim 1, wherein at least a portion of the winding member is an electric wire coated with a thermally fusible material that is wound into a uniformly layered coil block and is subsequently caked into a layered coil block by heating to fuse the thermally fusible material, said layered coil block being mounted on the bobbin.

6. The electromagnetic induction device as claimed in claim 1, further comprising a secondary circuit substrate;

wherein the bobbin is integrally formed with a substrate mount for supporting the secondary circuit substrate; and wherein the winding member comprises primary and secondary windings, said primary winding having opposite lead lines that are connected with a primary circuit substrate and said secondary winding being connected with the secondary circuit substrate.

7. The electromagnetic induction device as claimed in claim 6, wherein the substrate mount is positioned laterally of the bobbin and radially outwardly of at least one of the primary and secondary windings.

8. The electromagnetic induction device as claimed in claim 6, wherein the substrate mount is formed in a collar that defines one axial end of the bobbin, and is positioned axially outwardly of the primary and secondary windings.

9. The electromagnetic induction device as claimed in claim 1, wherein the bobbin comprises a plurality of bobbin pieces defined by dividing the bobbin in a direction axially thereof and wherein each of the core pieces is embedded in the corresponding bobbin piece.

10. The electromagnetic induction device as claimed in claim 9, wherein at least a portion of one of opposite surfaces of each of the first and second core pieces where no corresponding core arm is formed is exposed to an outside.

11. The electromagnetic induction device as claimed in claim 1, wherein the bobbin has at least one winding groove defined therein for receiving the winding member wound therein and comprises a plurality of bobbin pieces defined by dividing the bobbin in a direction axially thereof; and wherein the plural bobbin pieces are connected together such that a groove width of the winding groove is formed between the neighboring bobbin pieces and is variable.

12. The electromagnetic induction device as claimed in claim 11, wherein the bobbin comprises at least first and second bobbin pieces each including a hollow cylindrical body having a throughhole defined therein, said bore being defined by the respective throughholes in the bobbin pieces when the respective hollow cylindrical bodies of the first and second bobbin pieces are coaxially aligned with each other;

said bobbin pieces being assembled together to complete the bobbin with the hollow cylindrical body in the first bobbin piece inserted into the hollow cylindrical body in the second bobbin piece;

wherein one of an inner peripheral surface of the hollow cylindrical body in the first bobbin piece and an outer peripheral surface of the hollow cylindrical body in the second bobbin piece is formed with an engagement projection, and the other of the inner peripheral surface of the hollow cylindrical body in the first bobbin piece and the outer peripheral surface of the hollow cylindrical body in the second bobbin piece is formed with an axially extending guide groove and a plurality of circumferentially extending engagement grooves communicated with the guide groove and spaced a distance from each other in a direction axially of the bobbin; and wherein when the hollow cylindrical bodies are connected together one inserted into the other, said engagement projection is guided along the guide groove in the axial direction and is subsequently engaged in one of the engagement grooves upon relative displacement of the hollow cylindrical bodies in the circumferential direction.

* * * * *